US006348026B1

(12) United States Patent
Kuo

(10) Patent No.: US 6,348,026 B1
(45) Date of Patent: Feb. 19, 2002

(54) PULLING EXERCISER

(76) Inventor: Johnson Kuo, 5F, No. 6, Lane 12, Sec. 6, Hsin I Rd., Taipei (TW)

( * ) Notice: Subject to any disclaimer, the term of this patent is extended or adjusted under 35 U.S.C. 154(b) by 0 days.

(21) Appl. No.: 09/800,733

(22) Filed: Mar. 8, 2001

(51) Int. Cl.[7] ..... A63B 21/00
(52) U.S. Cl. ..... 482/126; 482/121; 482/904
(58) Field of Search ..... 482/126, 904, 482/121

(56) References Cited

U.S. PATENT DOCUMENTS 2,930,614 A * 3/1960 McIntosh ..... 482/126
3,427,023 A * 2/1969 Silberman ..... 482/126
4,722,526 A * 2/1988 Yang ..... 482/126
5,569,135 A * 10/1996 Chen ..... 482/126
5,665,040 A * 9/1997 Ho ..... 482/126
5,885,196 A * 3/1999 Gyorch ..... 482/126

* cited by examiner

*Primary Examiner*—Jerome W. Donnelly
(74) *Attorney, Agent, or Firm*—Varndell & Varndell, PL

(57) ABSTRACT

A pulling exerciser according to one embodiment of the invention includes a chest expander having a first handle at one end, two second handles at an opposite end, and a plurality of elastic cord members detachably connected between the first handle and the second handles, a coupling belt secured to the first handle by hook and loop materials, and a transverse bar inserted through a respective loop at each of the two distal ends of the coupling belt and adapted to secure the pulling exerciser to a top or bottom door gap for enabling the user to pull the second handles to exercise the muscles of the arms.

3 Claims, 27 Drawing Sheets

PULLING EXERCISER

BACKGROUND AND SUMMARY OF THE INVENTION

The present invention relates to physical exercising apparatus and, more specifically, to a simple, inexpensive pulling exerciser for exercising the muscles of the arms and/or the legs.

A variety of physical exercising apparatus have been disclosed for exercising the muscles of different parts of the body, and have appeared on the market. These conventional physical exercising apparatus are commonly heavy, complicated, and expensive.

The present invention has been accomplished under the circumstances in view. It is the main object of the present invention to provide a pulling exerciser, which can conveniently be secured to a door gap for pulling with the hand(s) or the leg(s) in any of a variety of postures to exercise the muscles of the arms or the legs. It is another object of the present invention to provide a pulling exerciser, which has means for fastening to the leg(s) for enabling the user to exercise the muscles of the leg(s). It is still another object of the present invention to provide a pulling exerciser, which can conveniently be adjusted to provide different resisting force to fit different exercising requirements. It is still another object of the present invention to provide a pulling exerciser, which is inexpensive to manufacture. It is still another object of the present invention to provide a pulling exerciser, which requires less storage space when not in use. According to one embodiment of the present invention, the pulling exerciser comprises a first handle, two second handles, a plurality of elastic cord members detachably connected between the first handle and the second handles, a coupling belt fastened to the first handle by hook and loop materials, and a transverse bar inserted through loops at the two distal ends of the coupling belt and adapted for securing the pulling exercising to a door gap. According to another embodiment of the present invention, the chest expander is comprised of a first handle, a second handle, and a plurality of elastic cord members connected between the first handle and the second handle, and a connecting belt is fastened to the second handle by hook and loop materials to hold a gaiter for securing to the user's leg for enabling the user to exercise the muscles of the leg. In either embodiment, each handle comprises a plurality of screw rods arranged in parallel at one side, and each elastic cord member has two swivel nuts respectively disposed at two distal ends and adapted for selectively threading onto the screw rods of the handles.

BRIEF DESCRIPTION OE THE DRAWINGS

DETAILED DESCRIPTION OF THE PREFERRED EMBODIMENT

Figure 1:
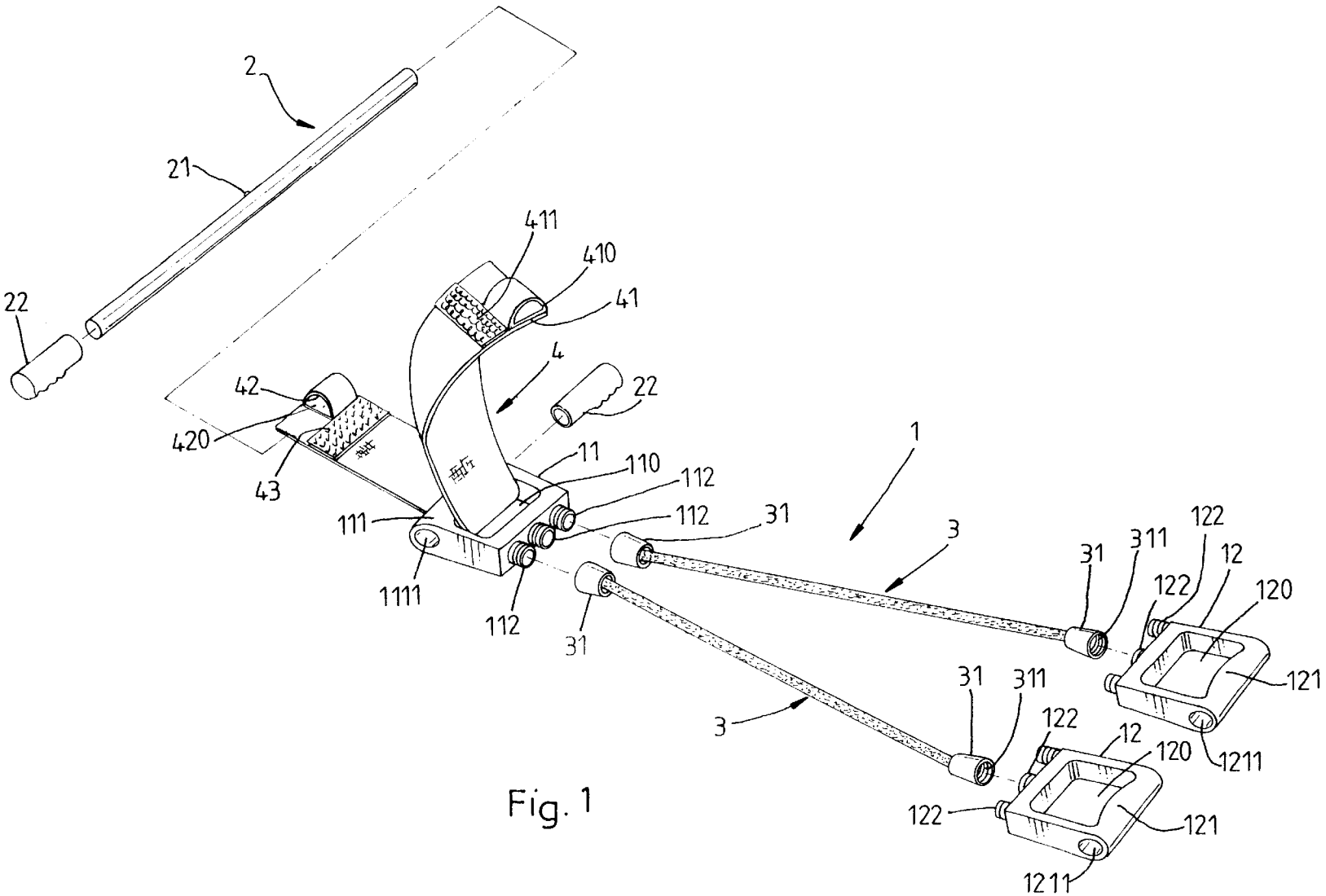
FIG. 1 is an exploded view of a pulling exerciser constructed according to a first embodiment of the present invention.
Figure 2:
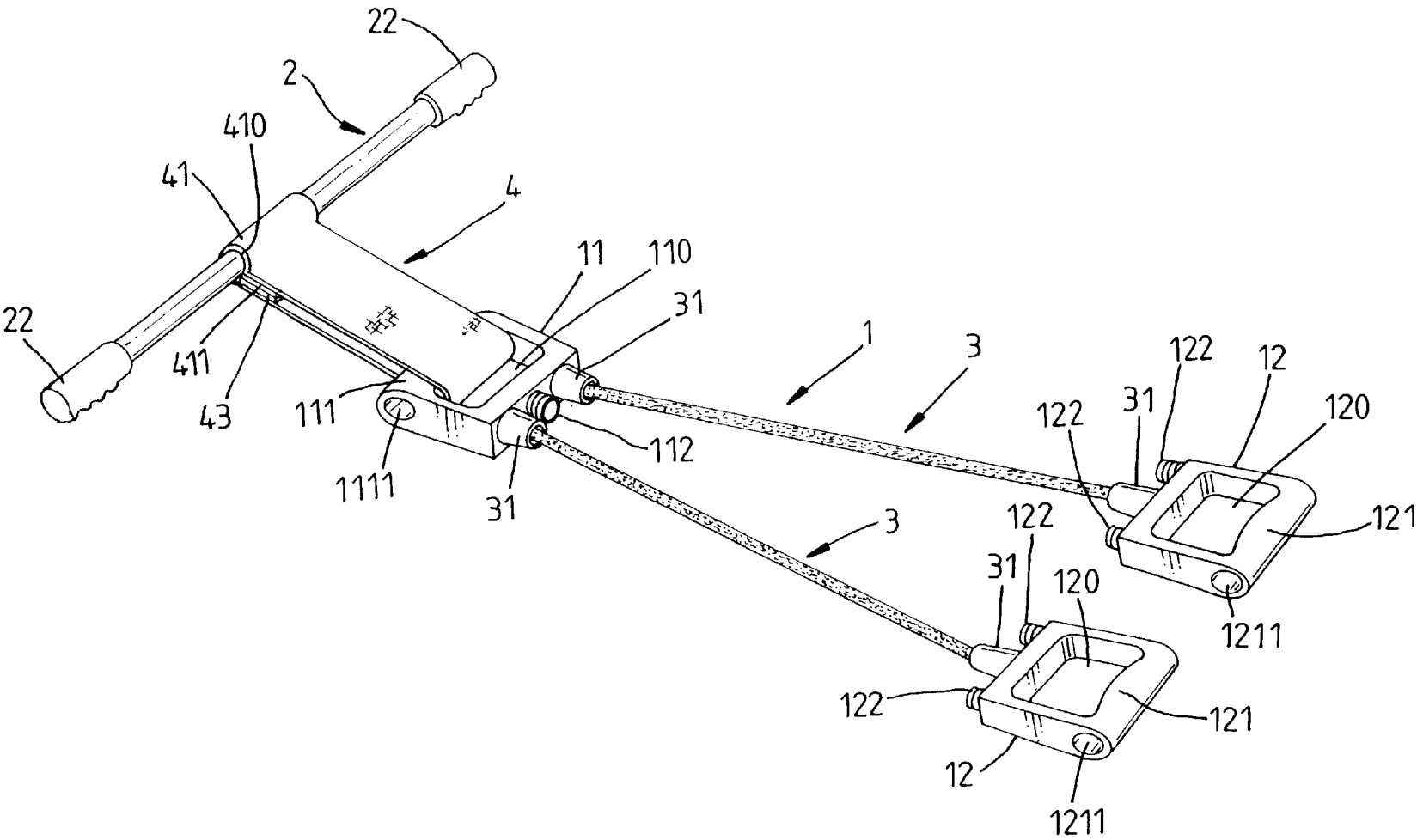
FIG. 2 is an elevational assembly view of the pulling exerciser according to the first embodiment of the present invention.

Referring to FIGS. 1 and 2, a pulling exerciser constructed according to a first embodiment of the present invention is shown comprised of a chest expander 1, a transverse bar 2, and a belt 4. The chest expander 1 is comprised of a plurality of handles, for example, one first handle 11 and two second handles 12, and a plurality of elastic cord members 3. In Figures from 1 through 4, two elastic cord members 3 are connected between the first handle 11 and the second handles 12. The first handle 11 and the second handles 12 are identical, each comprising a center opening 110 or 120, a handgrip 111 or 121 disposed at one side of the center opening 110 or 120, and an axle hole 1111 or 1211 axially extended through the handgrip 111 or 121.

The belt 4 is inserted through the center opening 110 of the first handle 11, having a first loop 41 and a second loop 42 respectively provided two distal ends of the inner sidewall thereof and coupled to the transverse bar 2, a tape of loop material 411 fixedly provided at one end of the inner sidewall adjacent to the first loop 41, and a tape of hook material 43 fixedly provided at the other end of the inner sidewall adjacent to the second loop 42 and adapted for fastening to the tape of loop material 411. The transverse bar 2 is inserted through the axial hole 410 of the first loop 41 and the axial hole 420 of the second loop 42 to secure the ends of the belt 4 together, having two end caps 22 fastened to two distal ends thereof. The elastic cord members 3 each comprise two swivel connectors 31 respectively disposed at two distal ends. The swivel connectors 31 each define a screw hole 311. The handles 11 and 12 each comprise a plurality of screw rods 112 or 122 outwardly disposed at one side of the respective center opening 110 or 120 opposite to the handgrip 111 or 121. The elastic cord members 3 are detachably fastened to the handles 11 and 12 by selectively threading the screw hole 311 of each swivel connector 31 onto the screw rods 112 or 122 of the handles 11 or 12.

Figure 3:
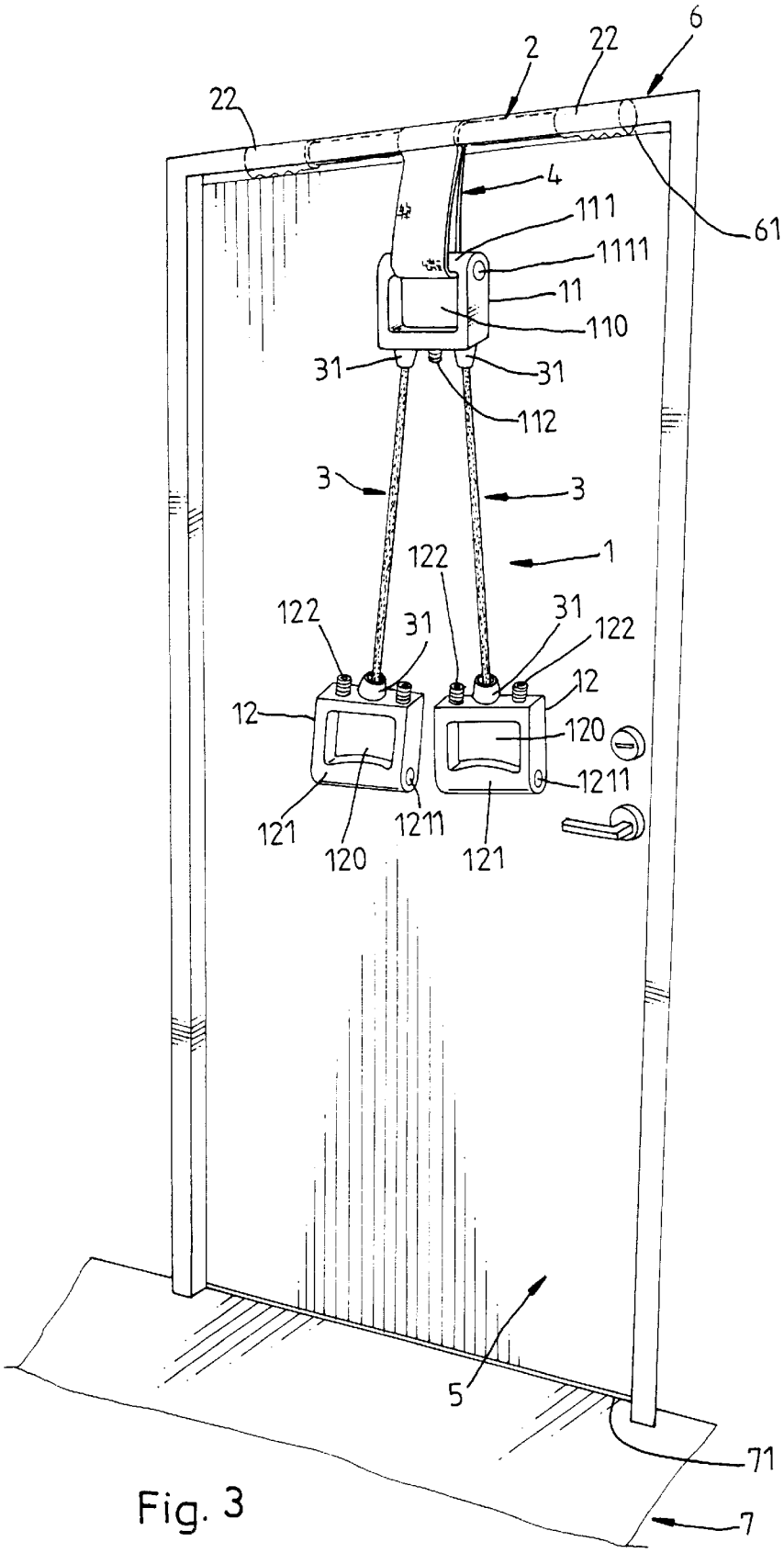
FIG. 3 shows the pulling exerciser of the first embodiment hung on the top of the door panel for exercise according to the present invention.
Figure 4:
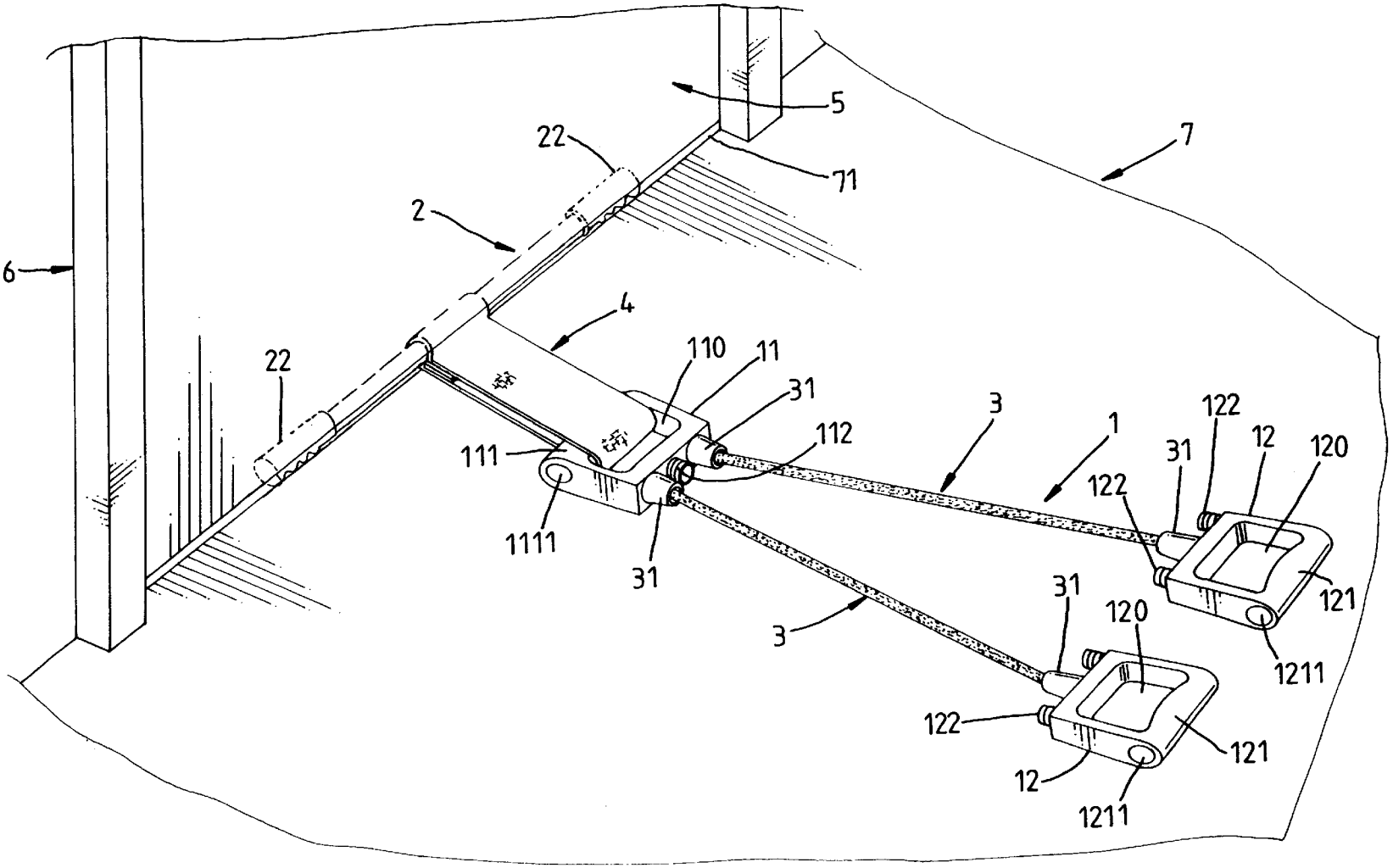
FIG. 4 shows the pulling exerciser of the first embodiment stopped at the bottom side of the door panel for exercise according to the present invention.

Referring to FIGS. 3 and 4 and FIGS. from 7 through 18, the belt 4 of the pulling exerciser can be inserted through the gap 61 between the top edge of the door panel 5 and the top rail of the door frame 6 (see FIG. 3) or the gap 71 between the bottom edge of the door panel 5 and the floor 7 (see FIG. 4), for enabling the transverse bar 2 to be stopped at the back side of the door panel 5 after closing the door panel 5. At this time, the user can pull the second handles 12 with the one hand or both hands to exercise the muscles of the arms when standing, bending the legs, sitting, or lying on the floor 7 with the face, the back, or one lateral side of the body facing the door panel 5.

Figure 22:
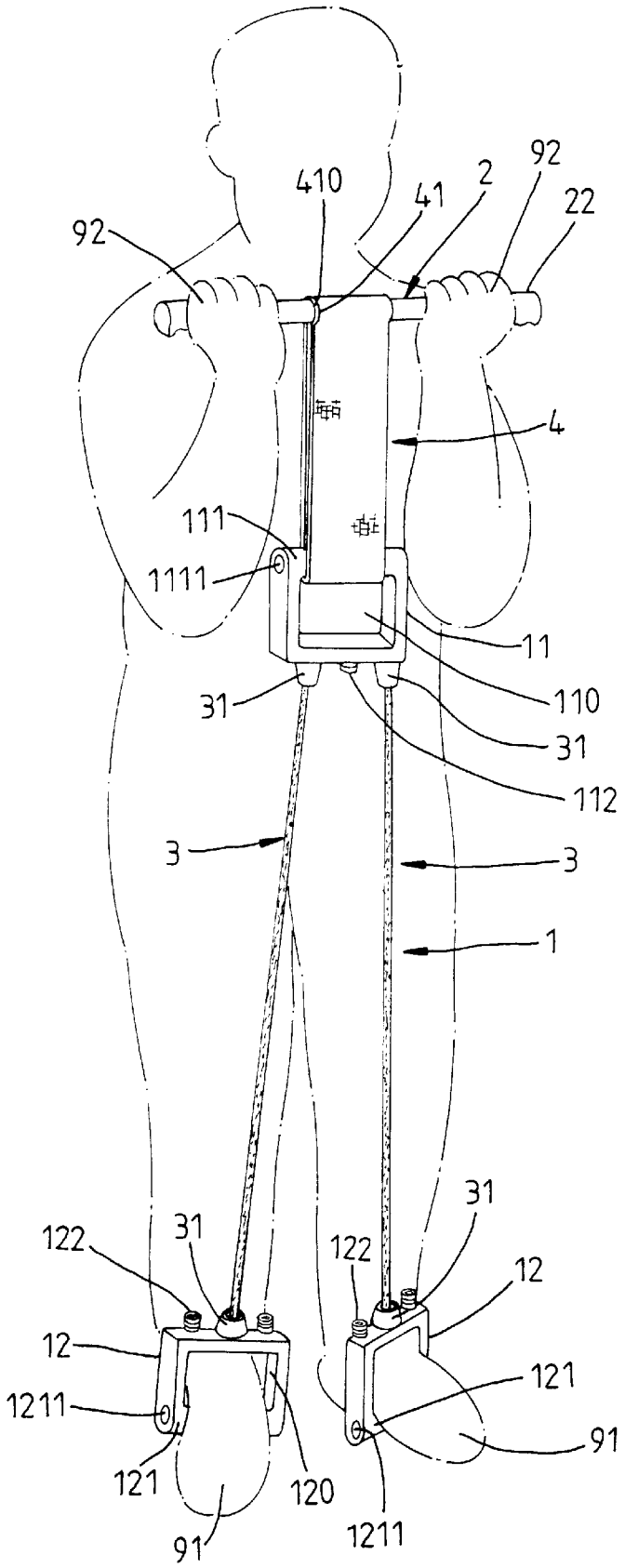
FIG. 22 shows still another exercising example of the first embodiment of the present invention.

In the application example shown in FIG. 22, the second handles 12 are hung on the user's feet 91, and the transverse bar 2 is held in the user's hands 92. By pulling the transverse bar 2 with the hands 92, the muscles of the arms are exercised.

Figure 23:
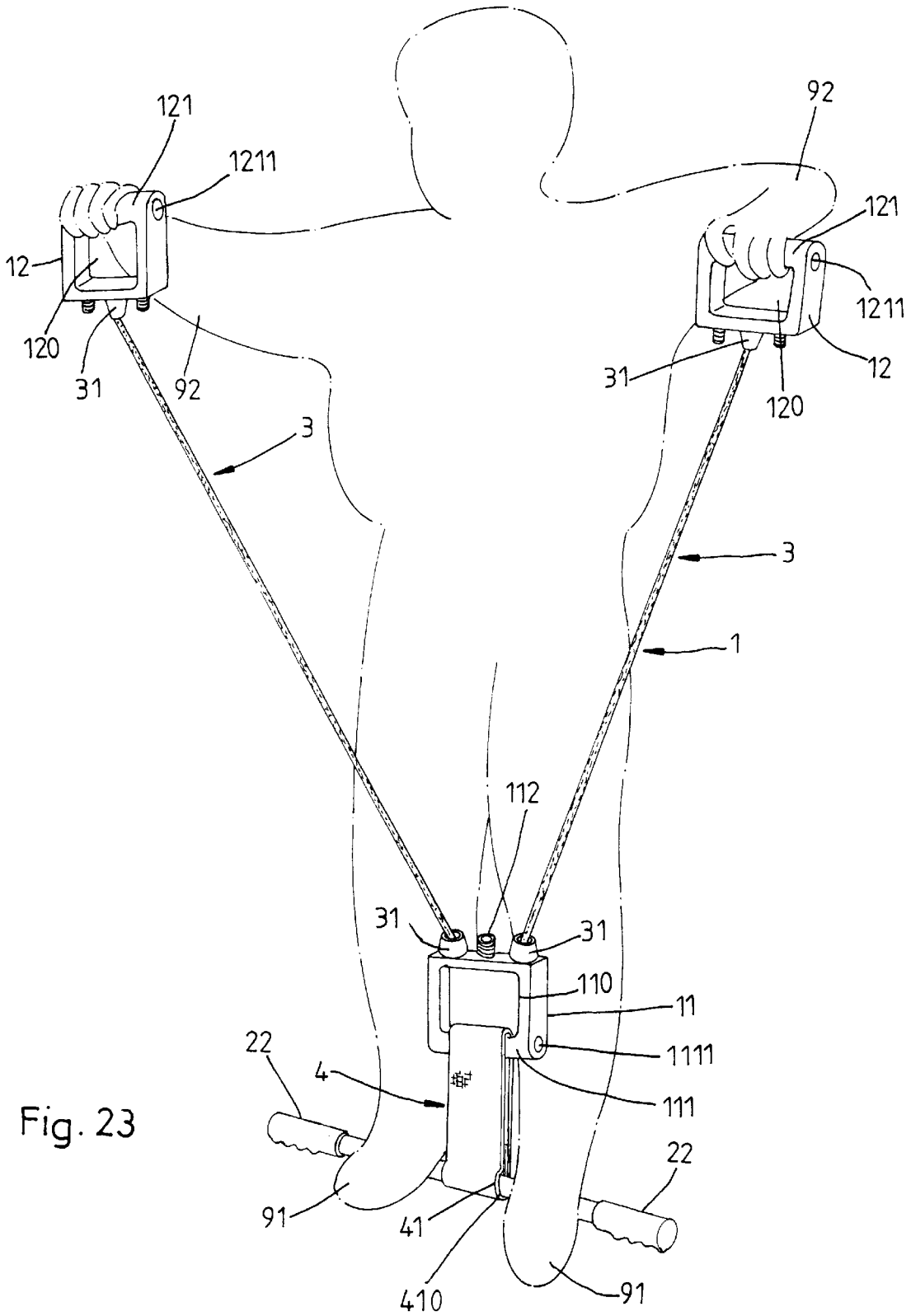
FIG. 23 shows still another exercising example of the first embodiment of the present invention.

In the application example shown in FIG. 23, the transverse bar 2 is put on the floor, the user stands on the floor with the feet 91 stepped on the transverse bar 2 and the hands 92 holding the second handles 12. When pulling the second handles 12 with the hands 92, the elastic cord members 3 impart a resisting force to the user's hands 92, and thus the muscles of the hands 92 are exercised.

Figure 5:
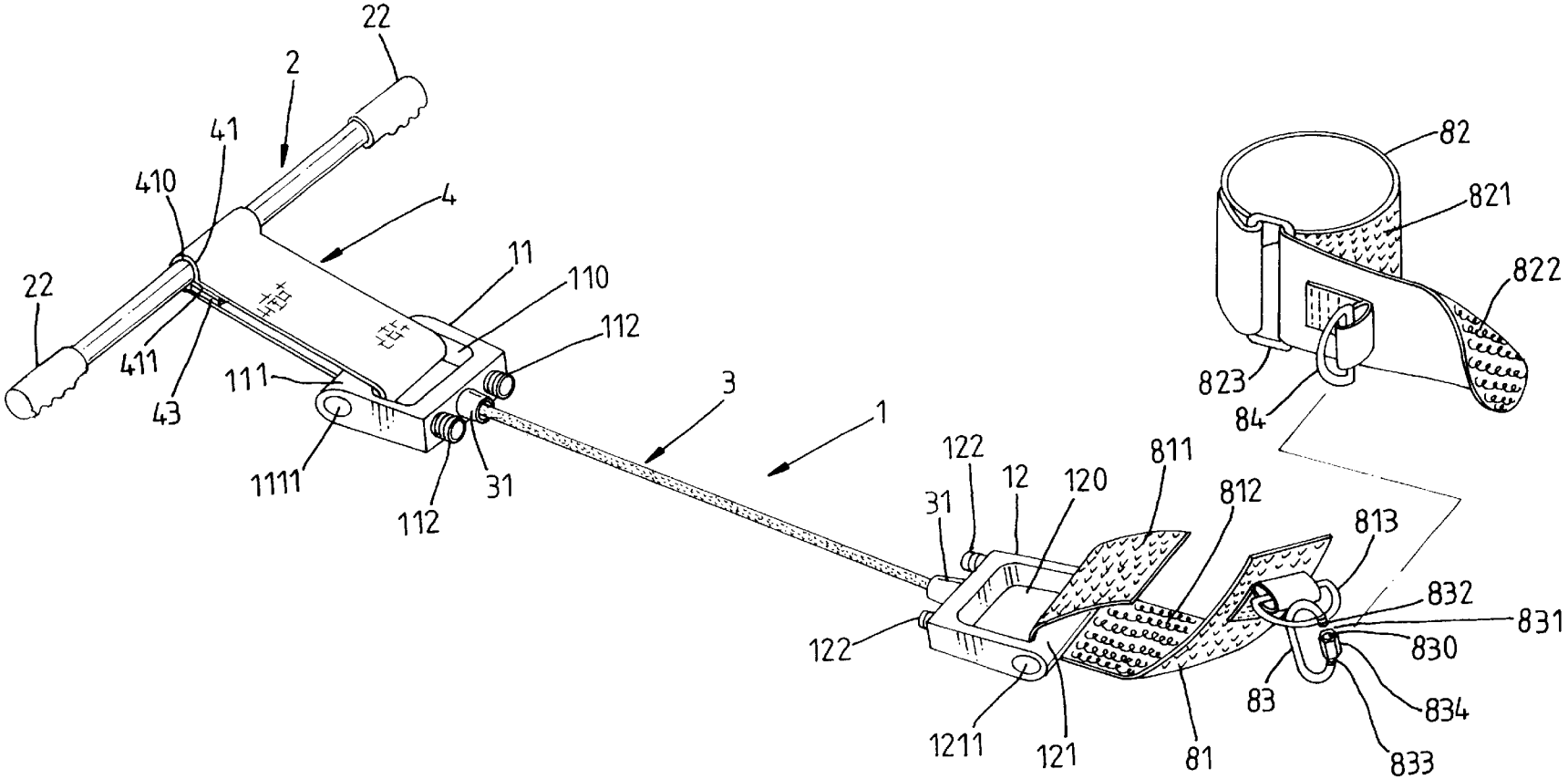
FIG. 5 is an exploded view of a pulling exerciser constructed according to a second embodiment of the present invention.
Figure 6:
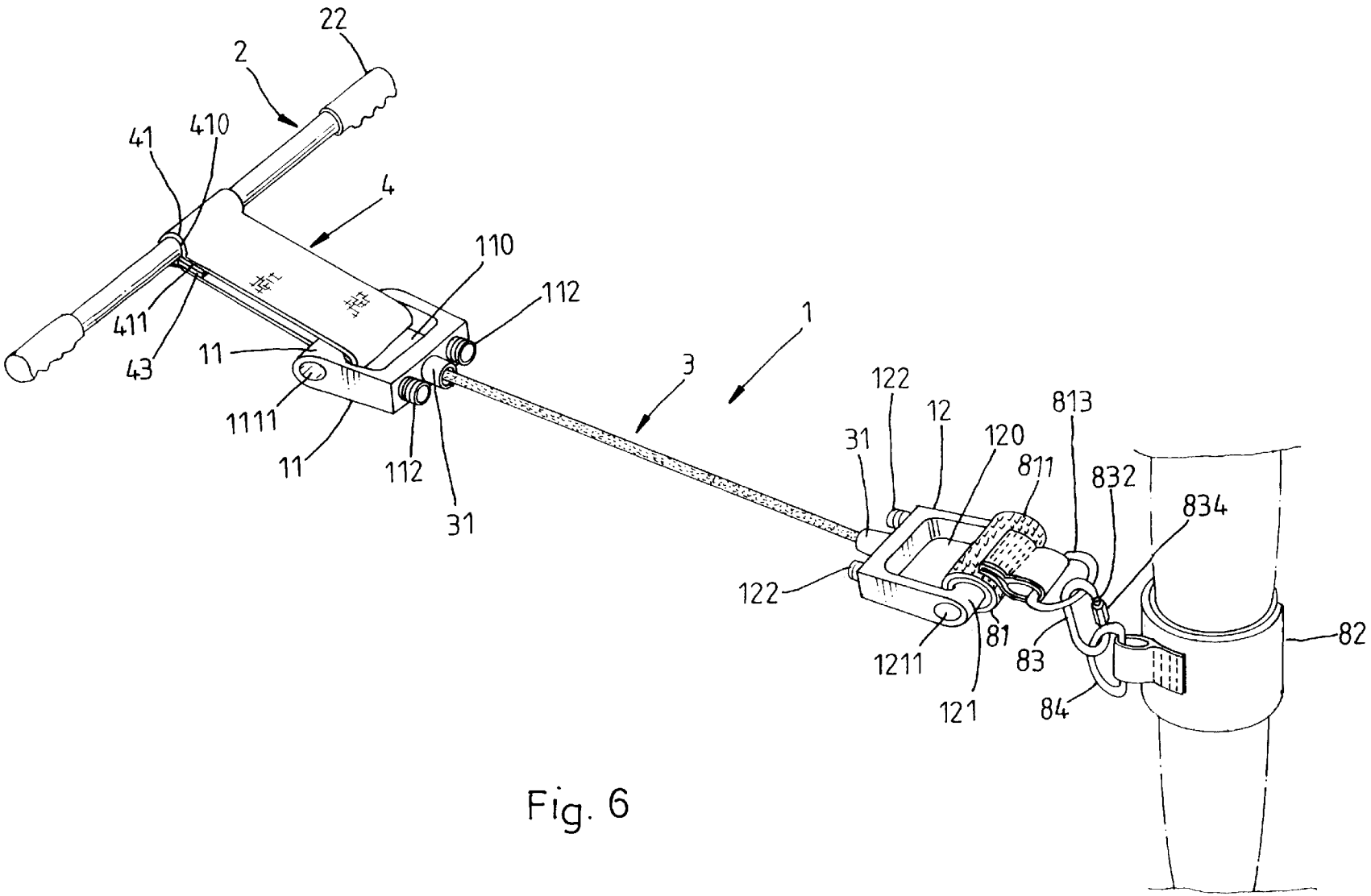
FIG. 6 is an elevational assembly view of the pulling exerciser of the second embodiment of the present invention.
Figure 7:
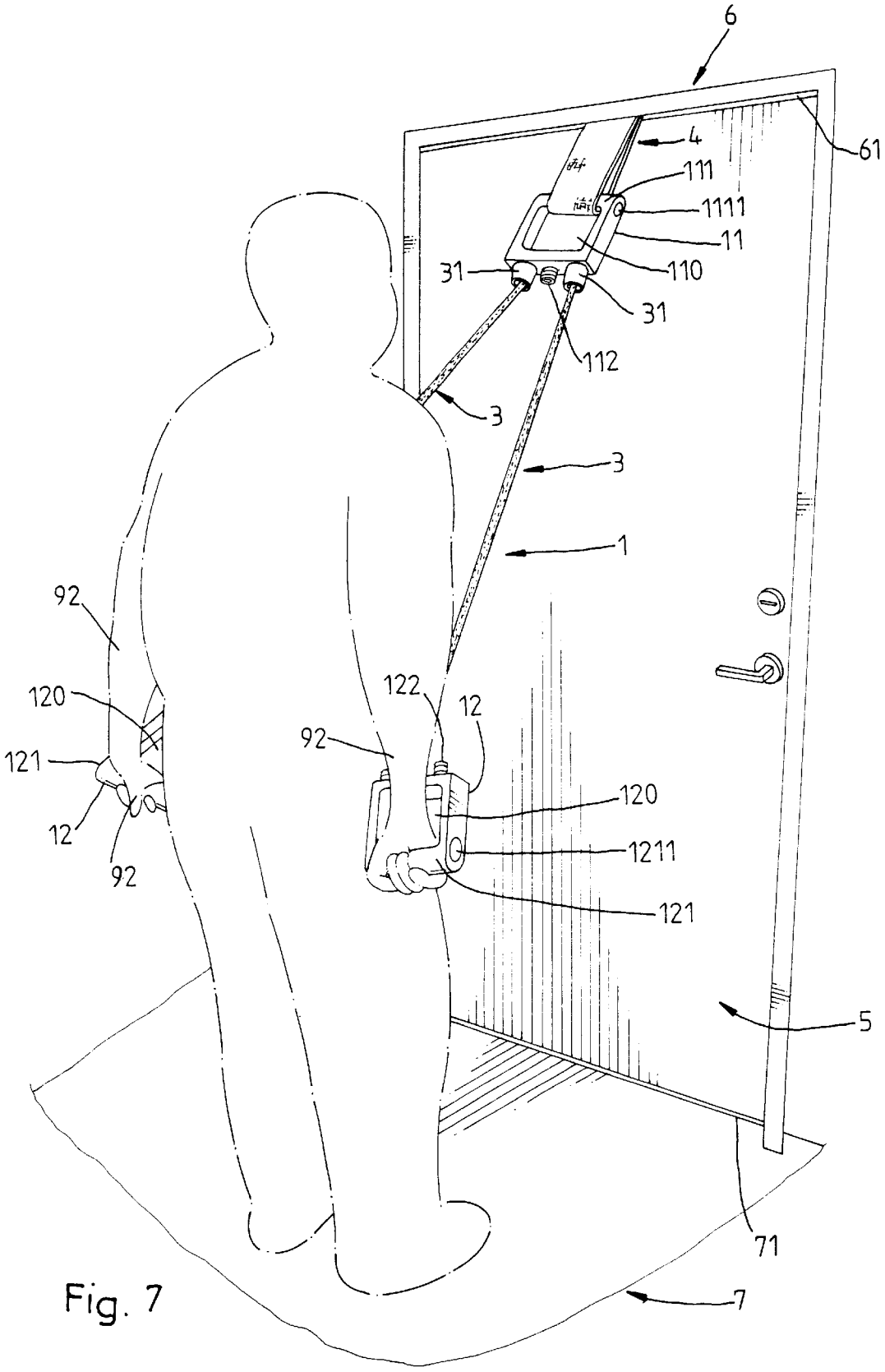
FIG. 7 shows an exercising example of the first embodiment of the present invention.
Figure 8:
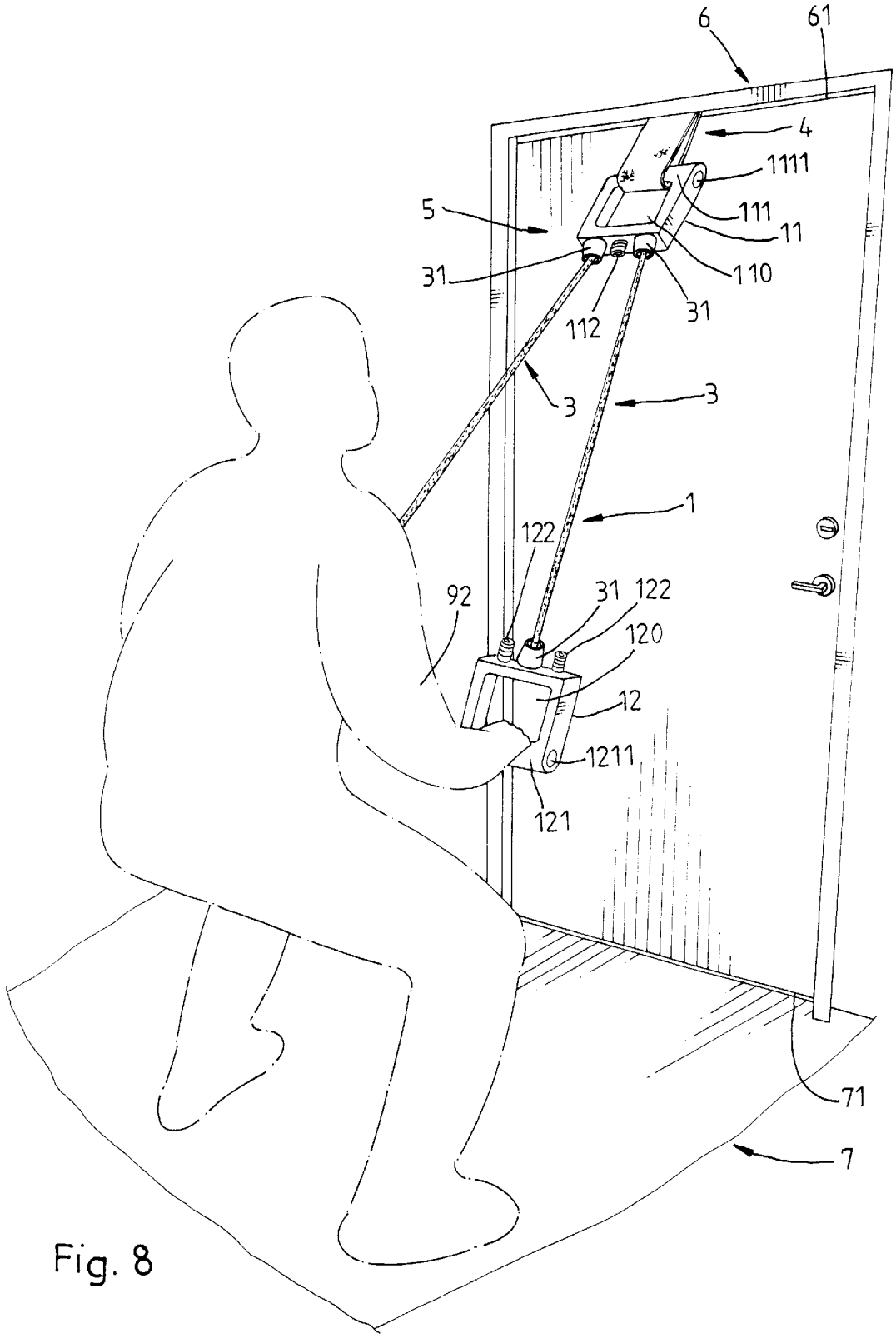
FIG. 8 shows another exercising example of the first embodiment of the present invention.
Figure 9:
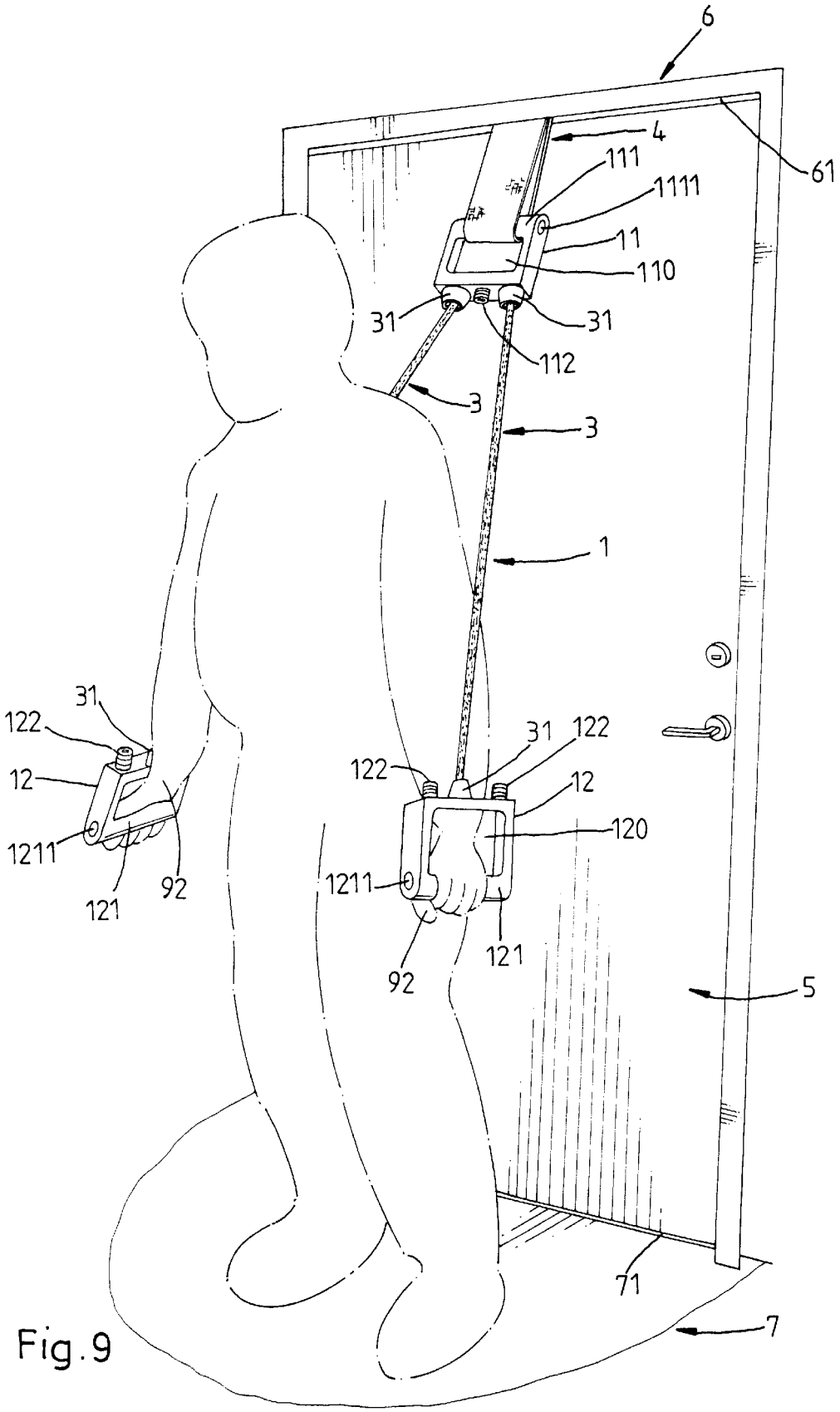
FIG. 9 shows still another exercising example of the first embodiment of the present invention.
Figure 10:
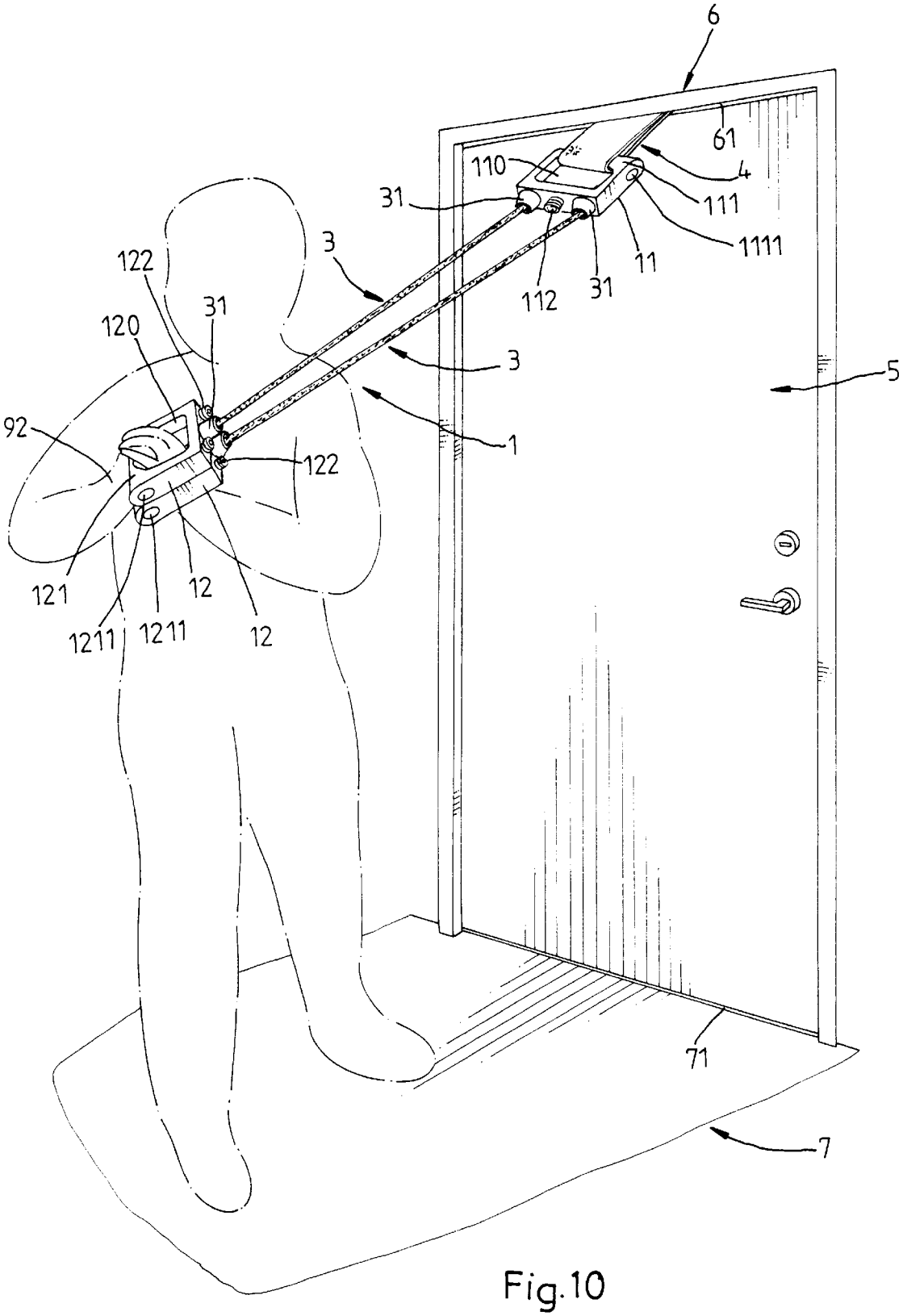
FIG. 10 shows still another exercising example of the first embodiment of the present invention.
Figure 11:
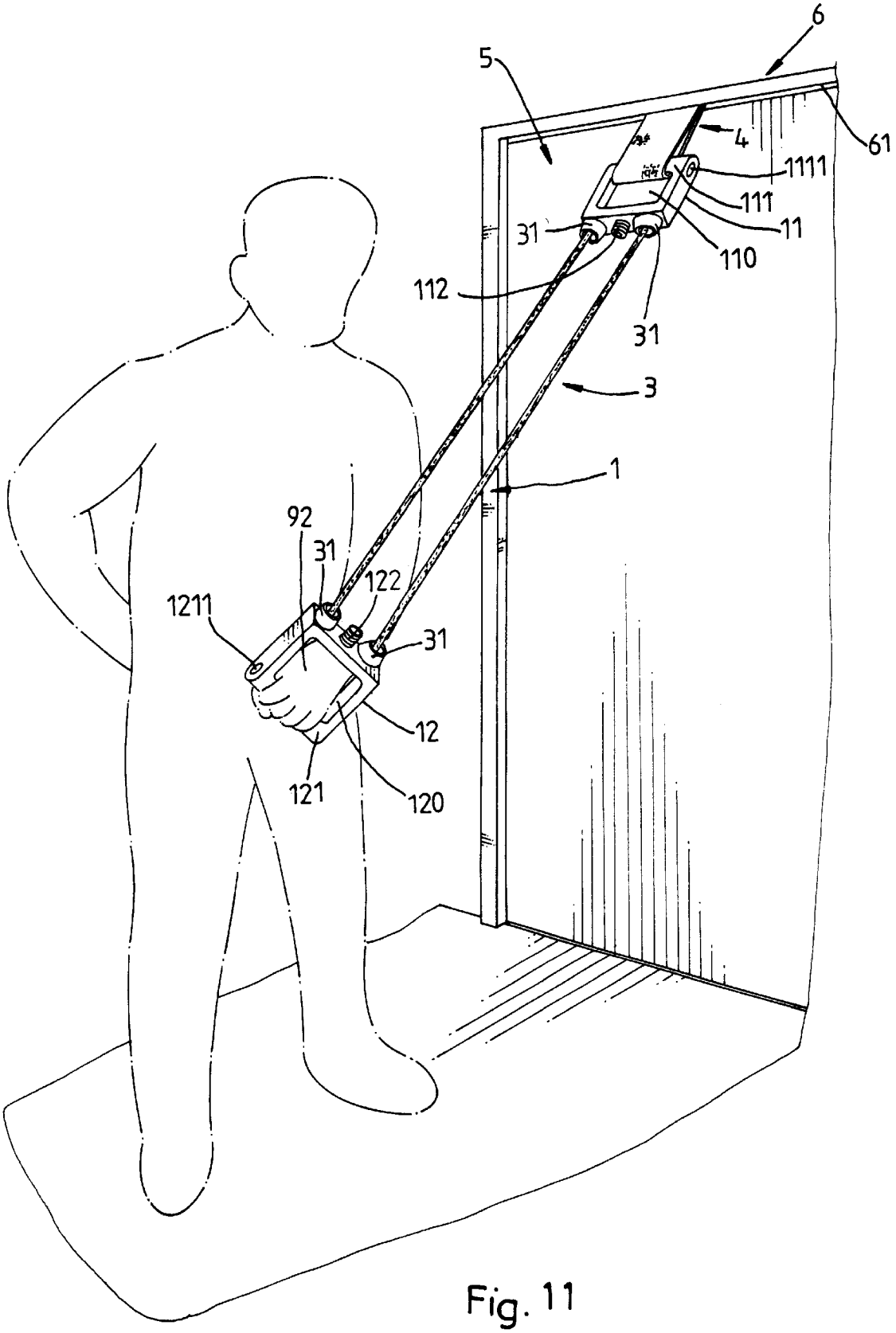
FIG. 11 shows still another exercising example of the first embodiment of the present invention.
Figure 12:
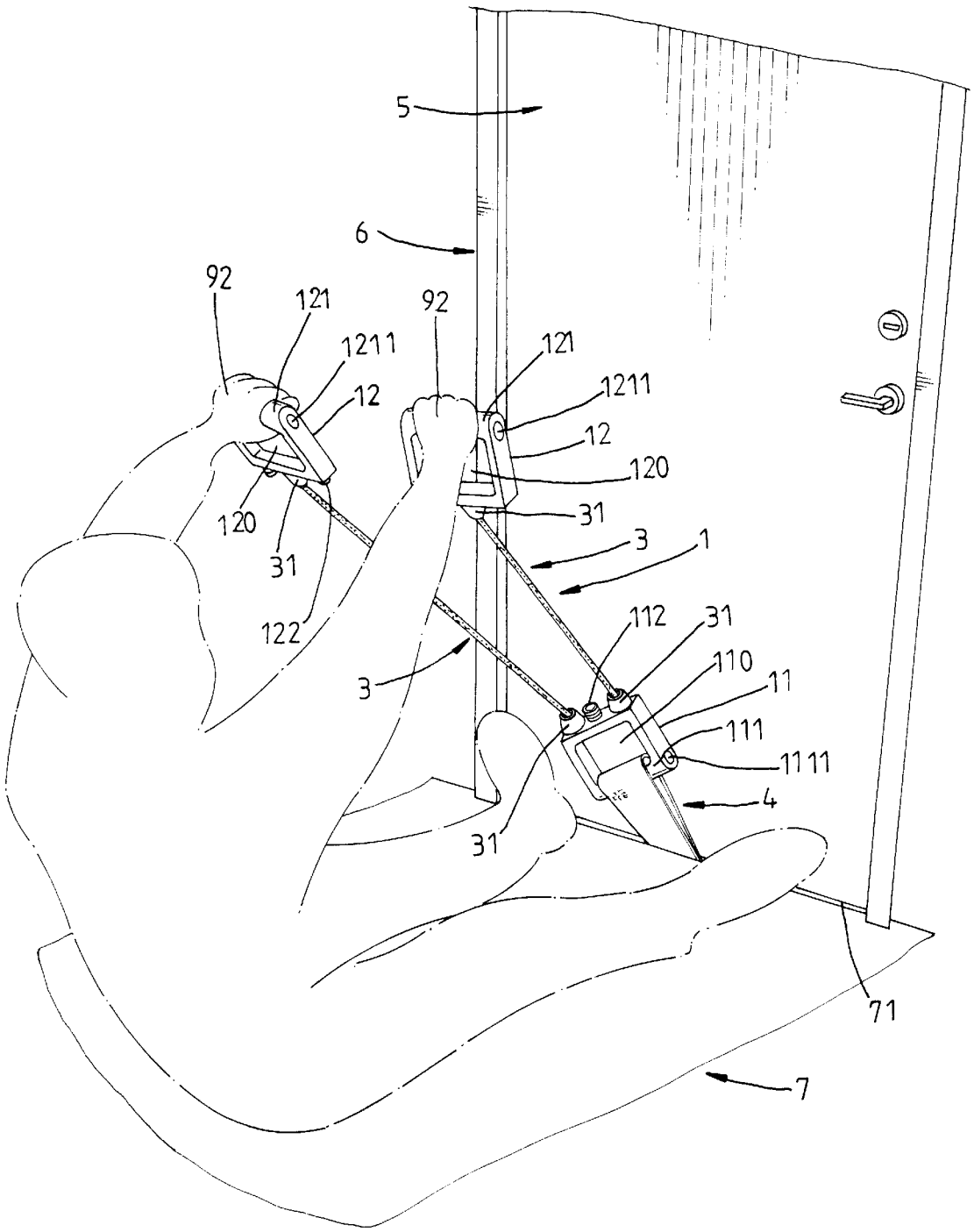
FIG. 12 shows still another exercising example of the first embodiment of the present invention.
Figure 13:
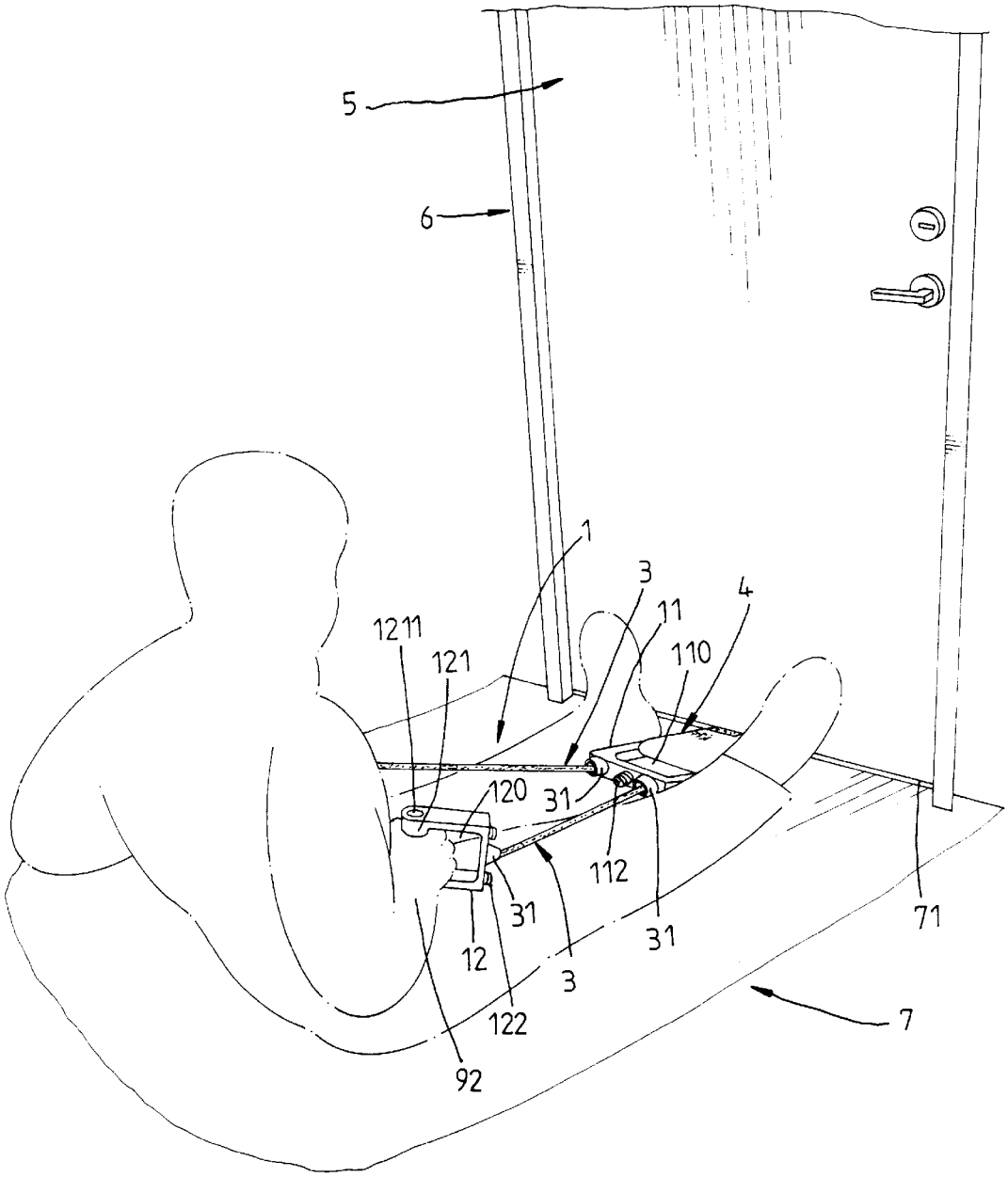
FIG. 13 shows still another exercising example of the first embodiment of the present invention.
Figure 14:
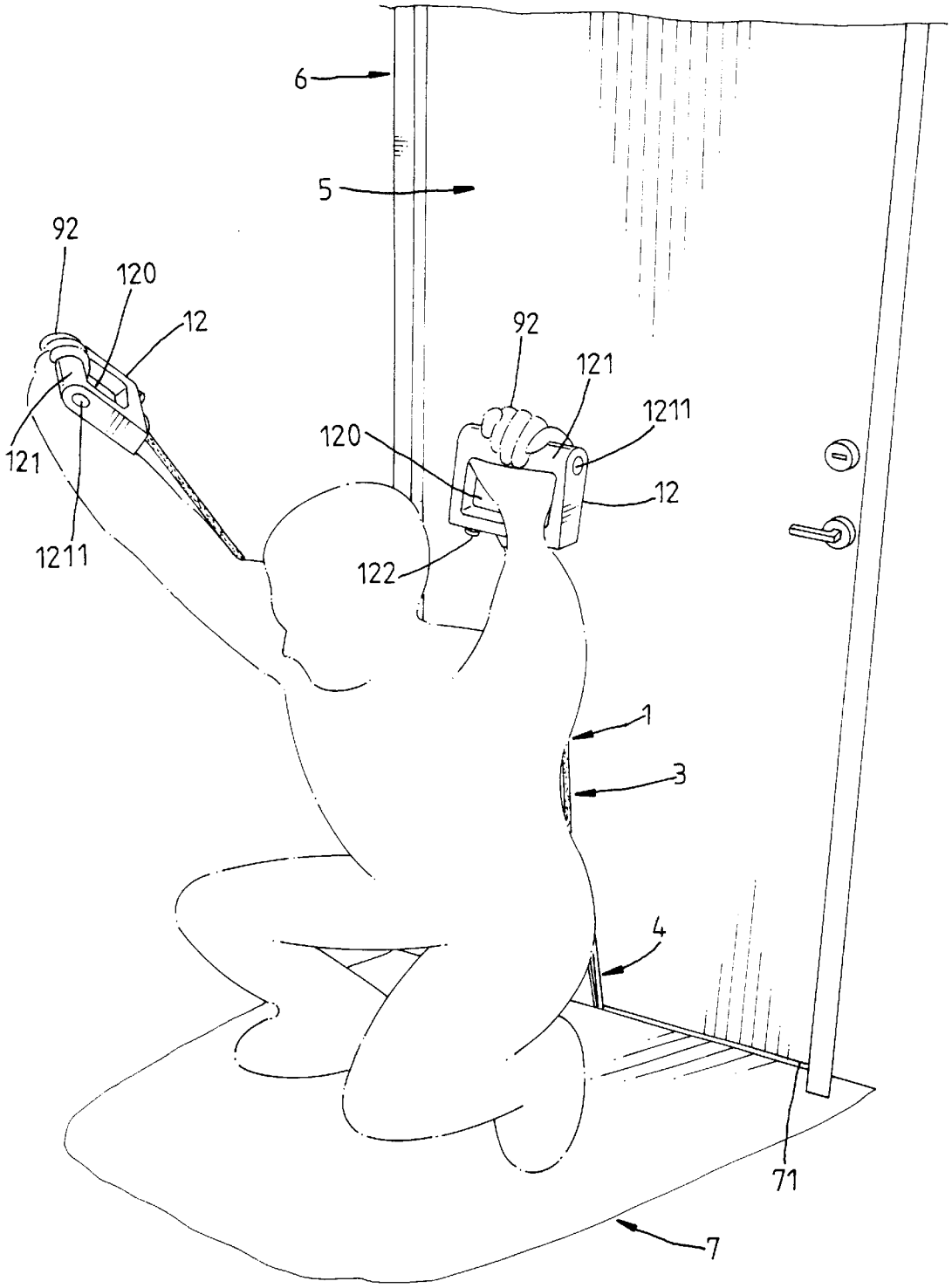
FIG. 14 shows still another exercising example of the first embodiment of the present invention.
Figure 15:
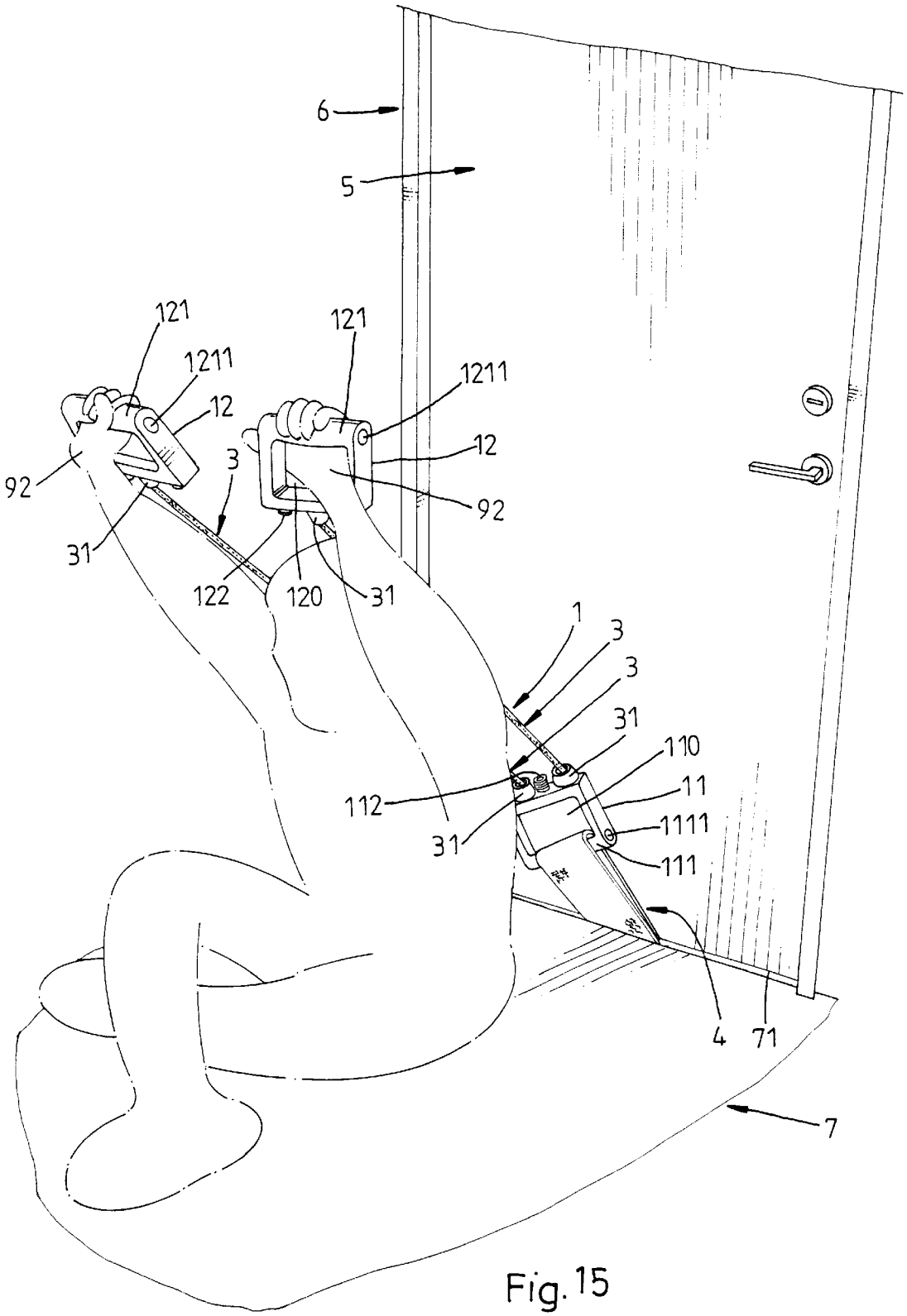
FIG. 15 shows still another exercising example of the first embodiment of the present invention.
Figure 16:
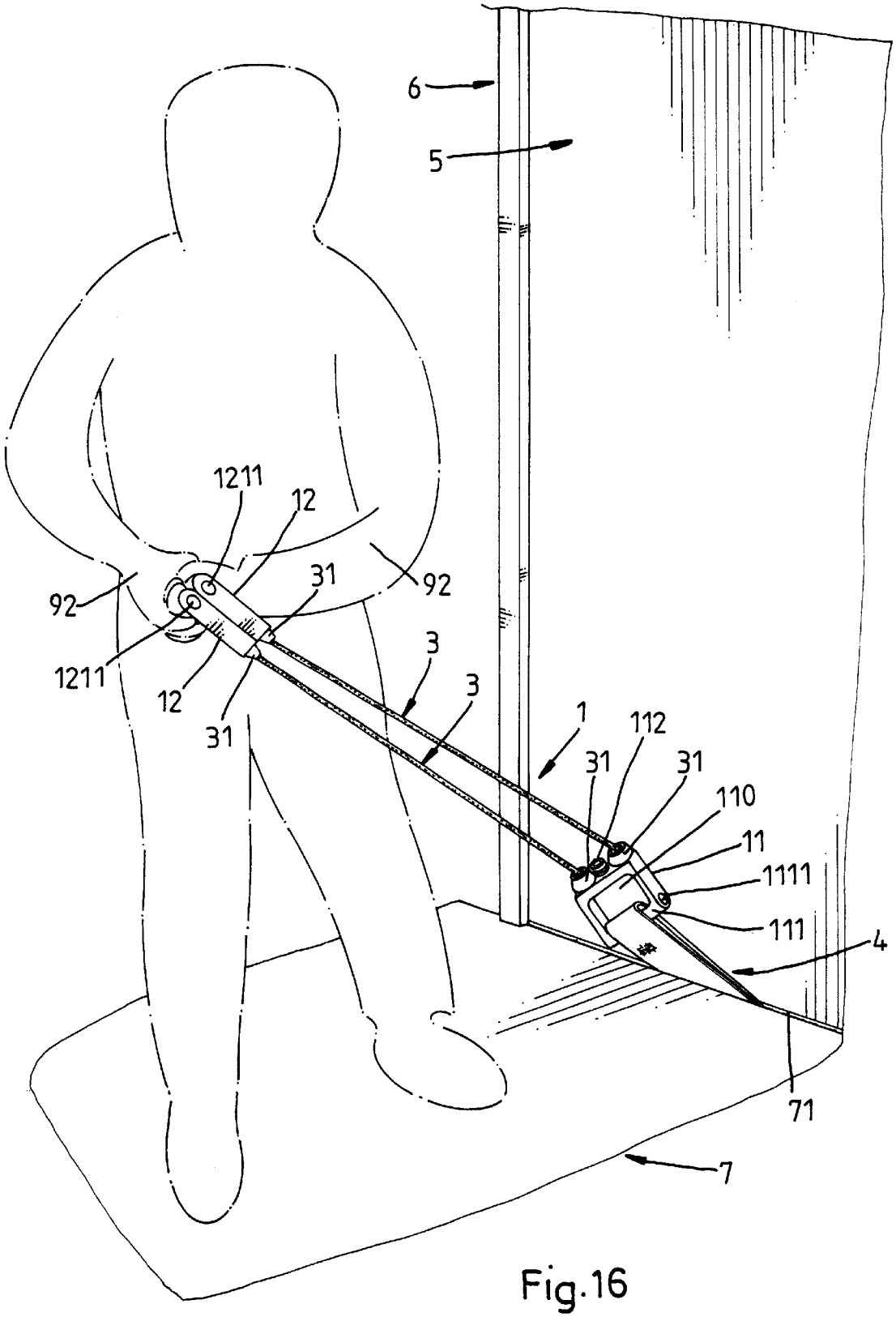
FIG. 16 shows still another exercising example of the first embodiment of the present invention.
Figure 17:
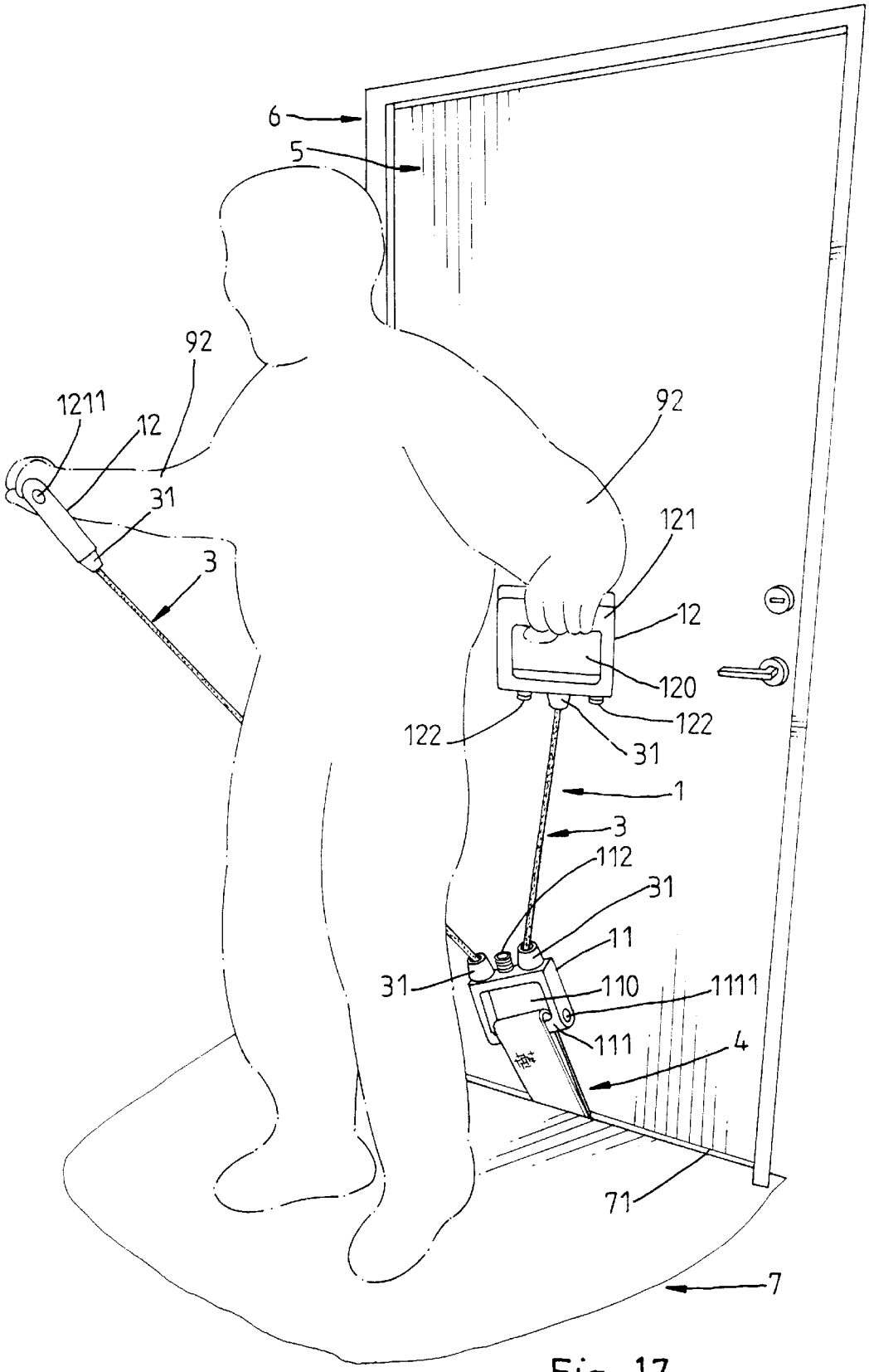
FIG. 17 shows still another exercising example of the first embodiment of the present invention.
Figure 18:
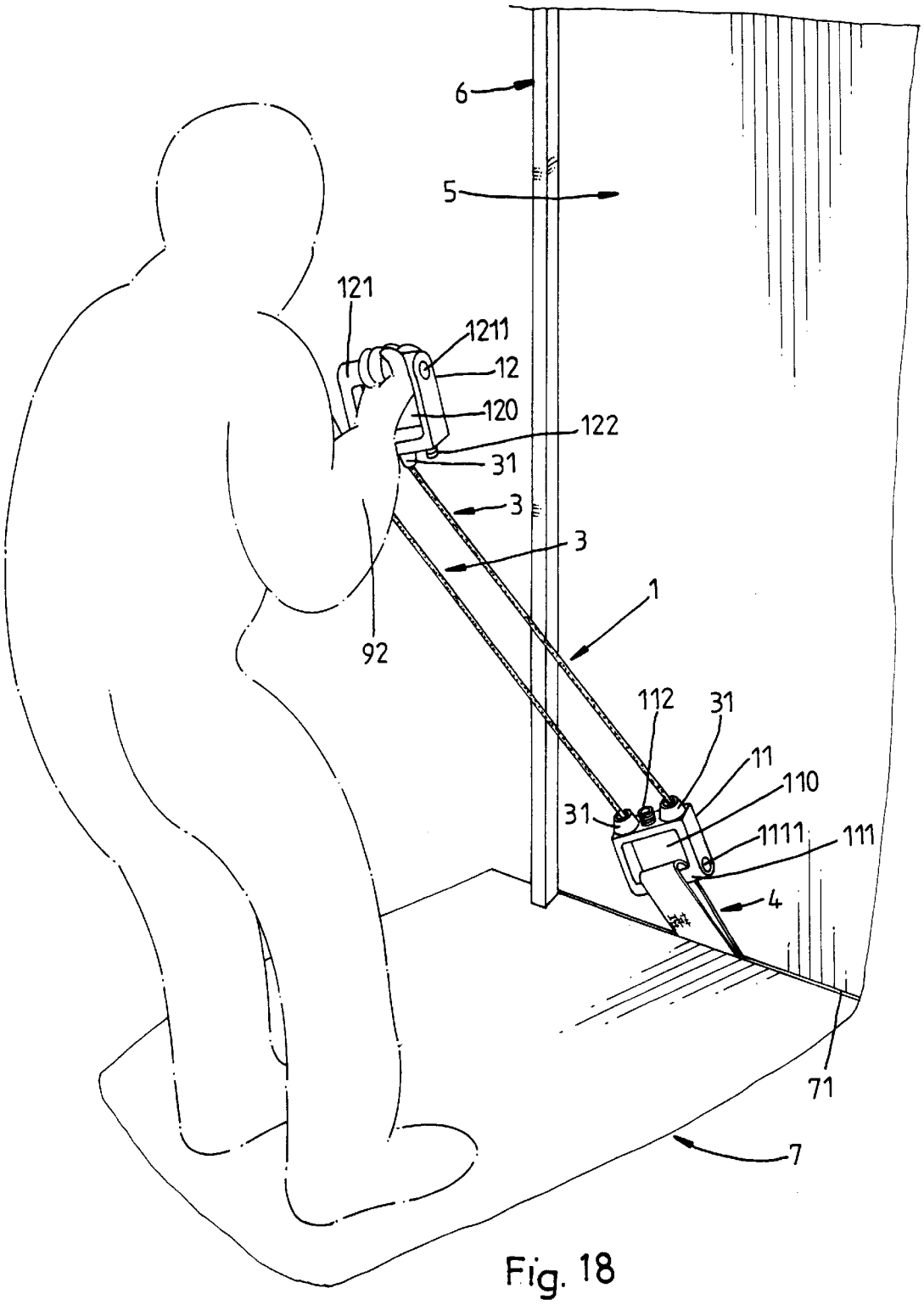
FIG. 18 shows still another exercising example of the first embodiment of the present invention.
Figure 19:
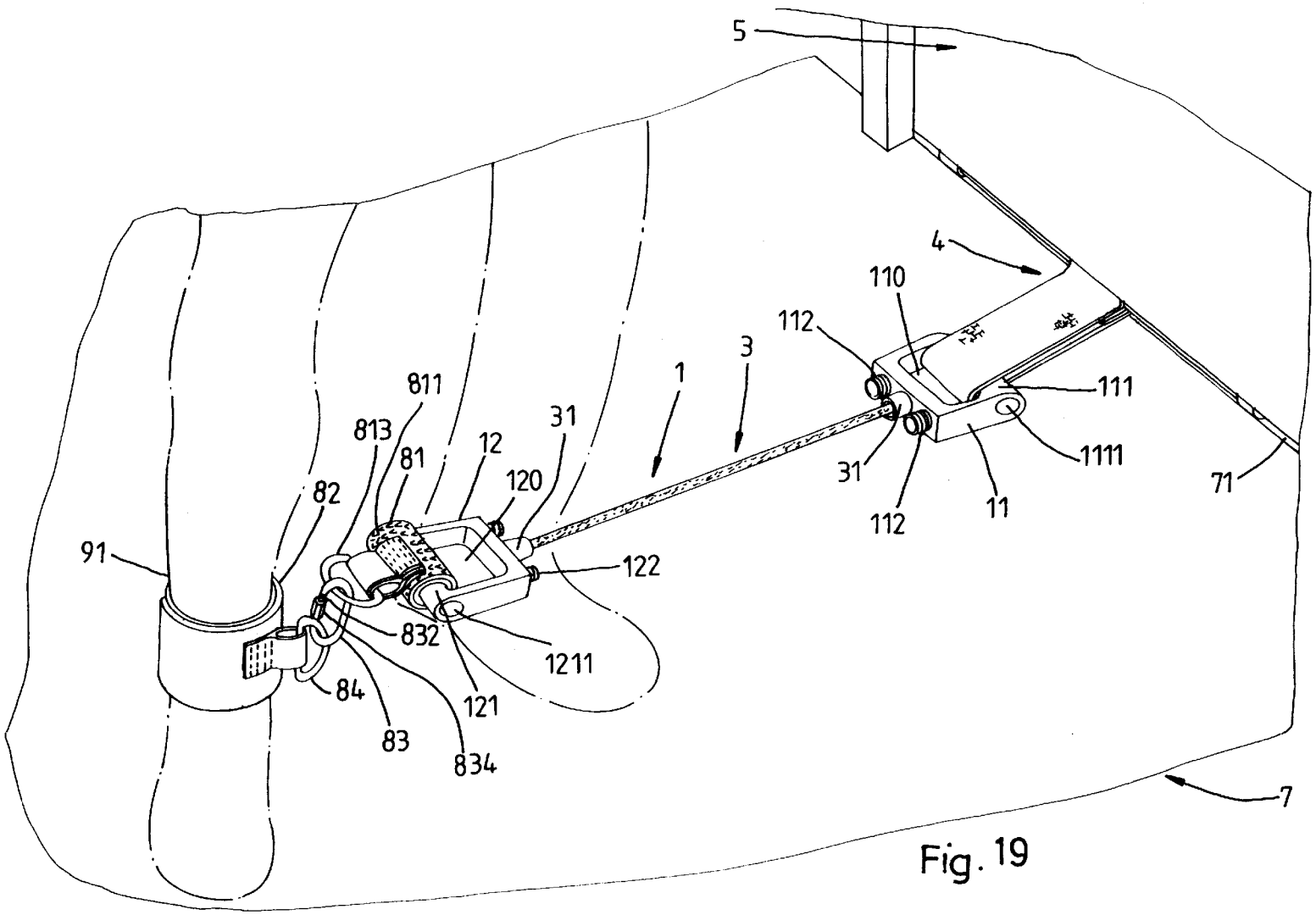
FIG. 19 shows an exercising example of the second embodiment of the present invention.
Figure 20:
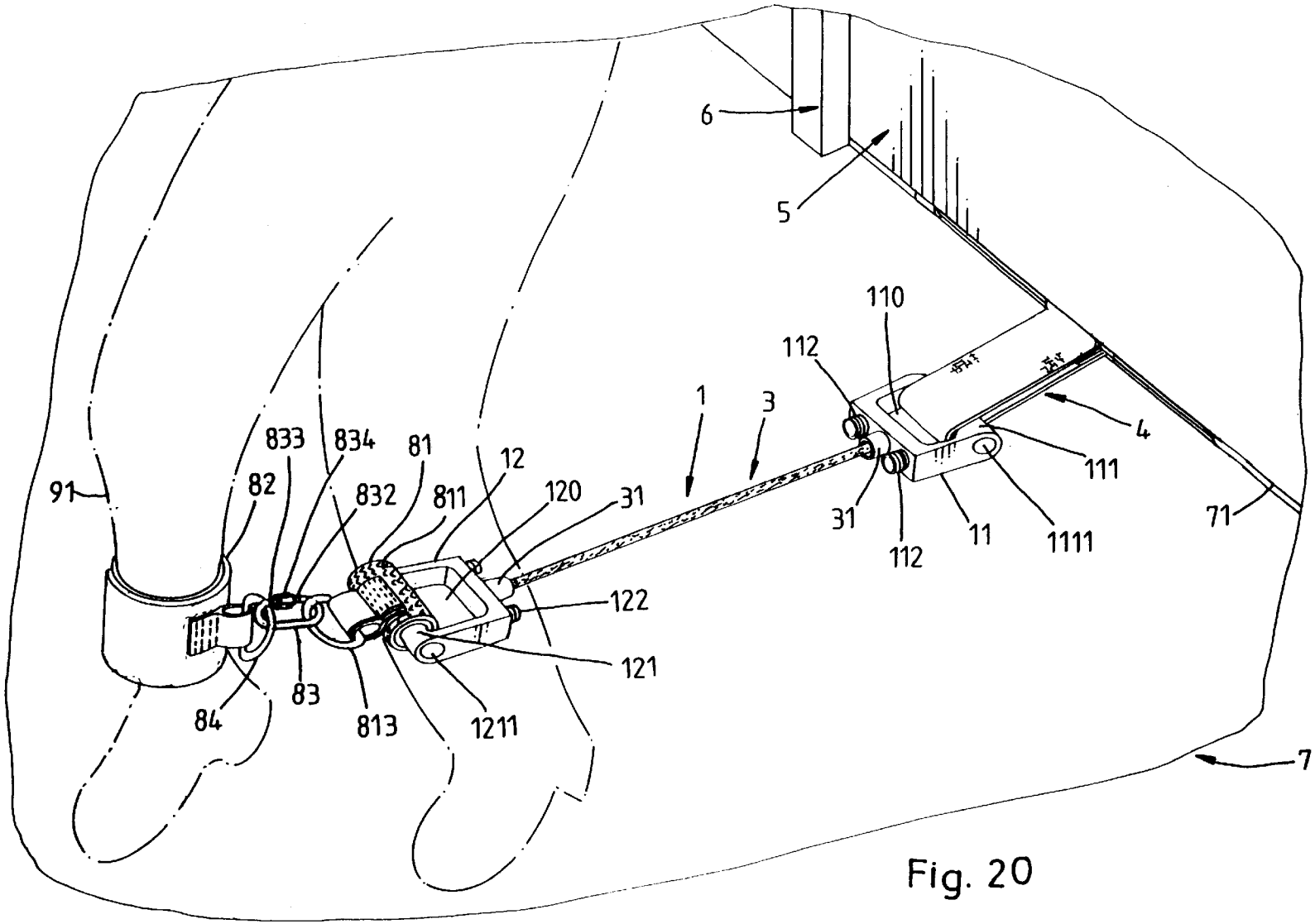
FIG. 20 shows another exercising example of the second embodiment of the present invention.

FIGS. 5 and 6 show a pulling exerciser constructed according to a second embodiment of the present invention. According to this embodiment, the pulling exerciser comprises a chest expander 1, which is comprised of a first handle 11, a second handle 12 and at least one elastic cord member 3 connected between the first handle 11 and the second handle 12, a transverse bar 2, a belt 4 coupled between the first handle 11 and the transverse bar 2, a gaiter 82 adapted for fastening to the user's leg 91, and a connecting belt 81 adapted for securing the gaiter 82 to the second handle 12.The connecting belt 81 is provided with a fixed tape of hook material 811 and a fixed tape of loop material 812, a D-shaped ring 813, and a carbin hook 83 coupled to the ring 813 and adapted to secure the gaiter 82 to the connecting belt 81. The fixed tape of hook material 811 and the fixed tape of loop material 812 are hooked up to secure the connecting belt 81 to the handgrip 121 of the second handle 12. The carbin hook 83 comprises an open ring-like hook body 830, two screw rods 832 and 833 respectively extended from two distal ends of the hook body 830 and aimed at each other, and an adjustment nut 834 threaded onto the screw rods 832 and 833 and rotated forwards/backwards to close/open the gap 831 between the screw rods 832 and 833. The gaiter 82 comprises a belt fitting 823 adapted to adjust the gaiter 82 to fit the user's leg 91, a fixed tape of hook material 821 and a fixed tape of loop material 822 adapted for securing the gaiter 82 to the user's leg 91, and a D-shaped ring 84 adapted for securing the gaiter 82 to the carbin hook 83 of the connecting belt 81. FIGS. 19 and 20 show two different exercising examples of the pulling exerciser according to the second embodiment of the present invention.

Figure 21:
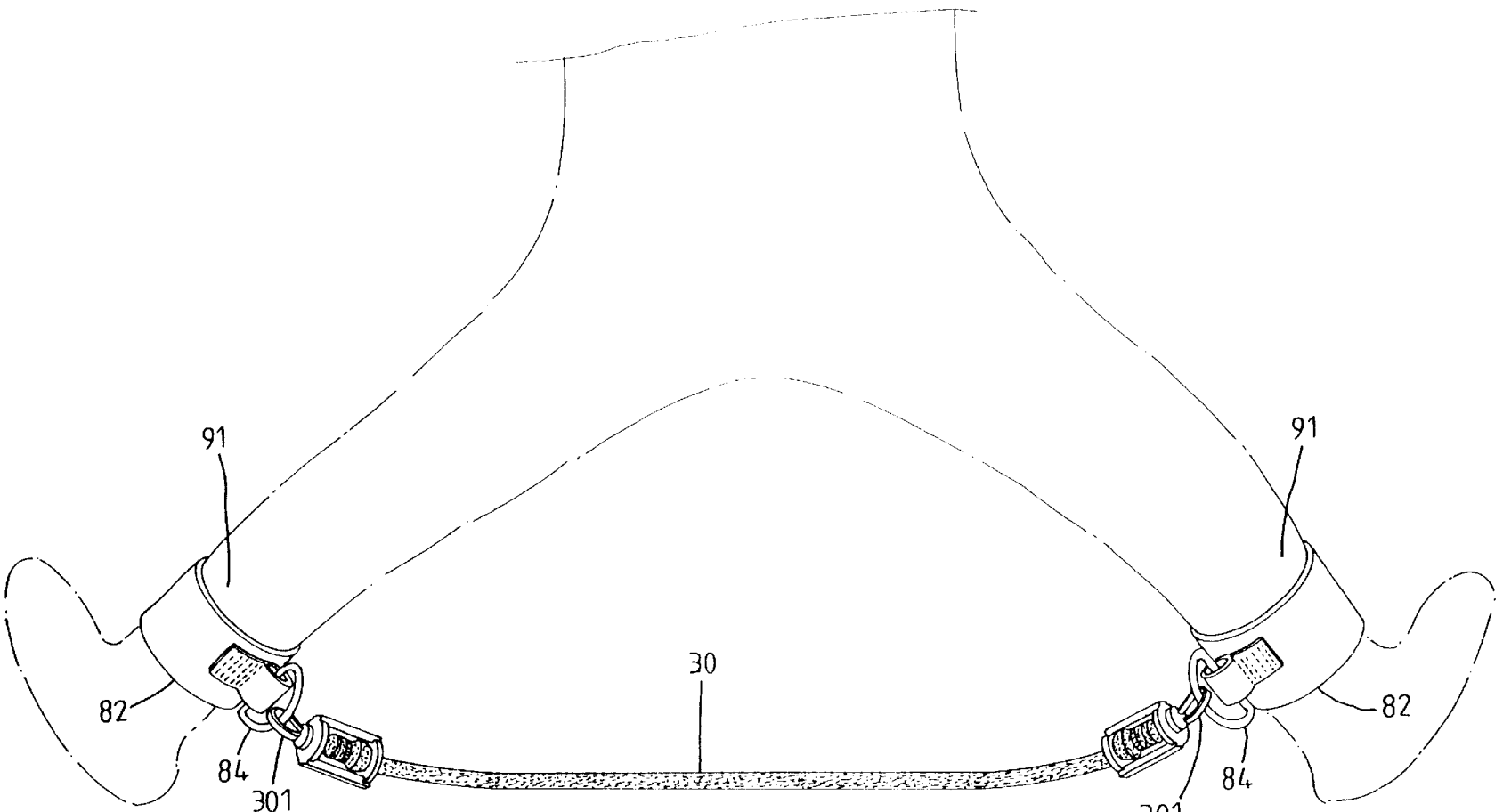
FIG. 21 is an elevational view of a pulling exerciser constructed according to a third embodiment of the present invention, showing the gaiters fastened to the user's legs.

FIG. 21 shows a pulling exerciser constructed according to a third embodiment of the present invention. According to this embodiment, the pulling exerciser comprises two gaiters 82 respectively detachably fastened to the user's two legs 91, and an elastic cord member 30 connected between the gaiters 82. The elastic cord member 30 comprises two swivel connectors 301 at two ends respectively connected to the D-shaped ring 84 of each of the gaiters 82. The gaiters 82 are identical to that of the aforesaid second embodiment of the present invention.

Figure 24:
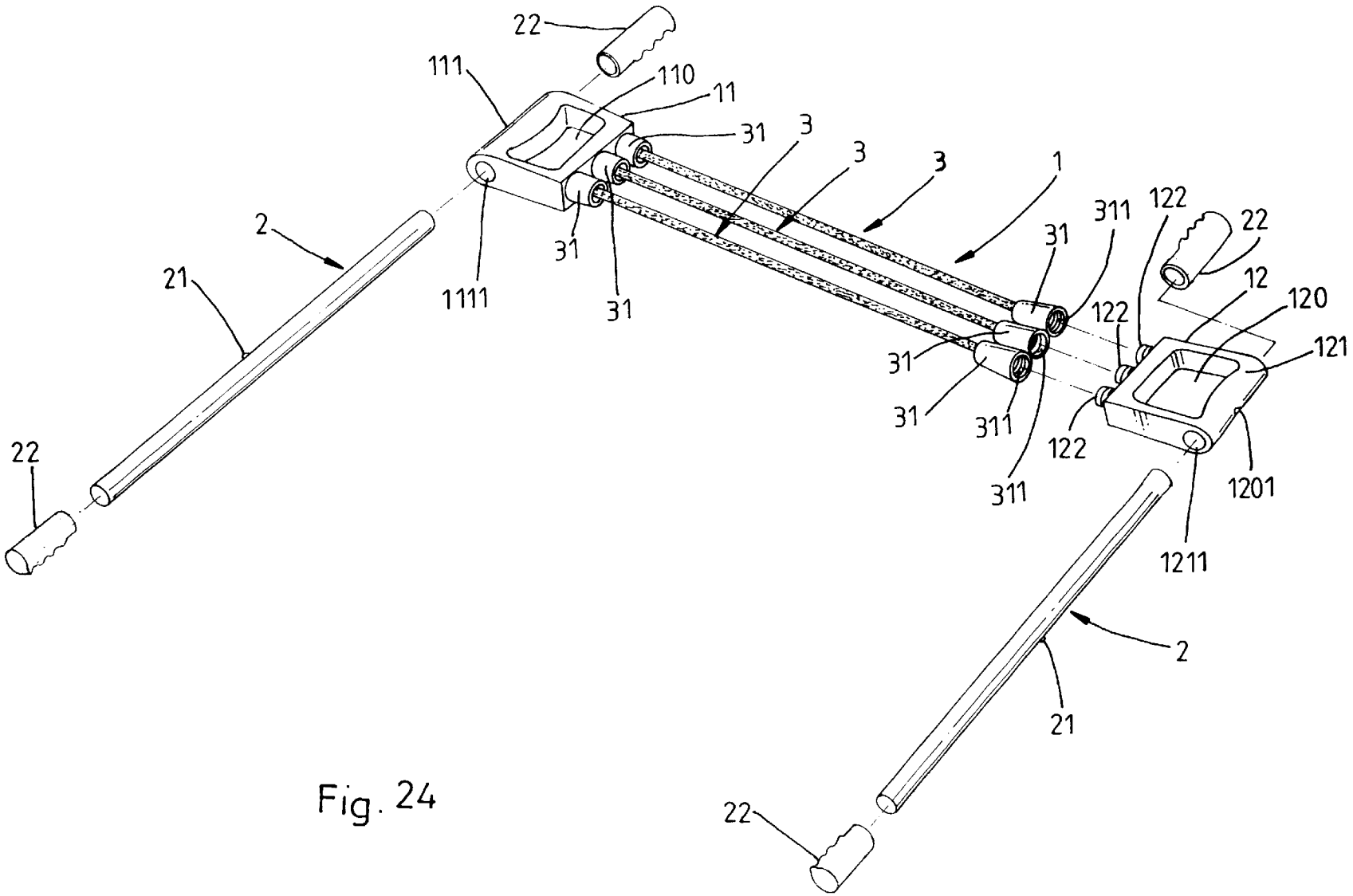
FIG. 24 is an exploded view of a pulling exerciser constructed according to a fourth embodiment of the present invention.
Figure 25:
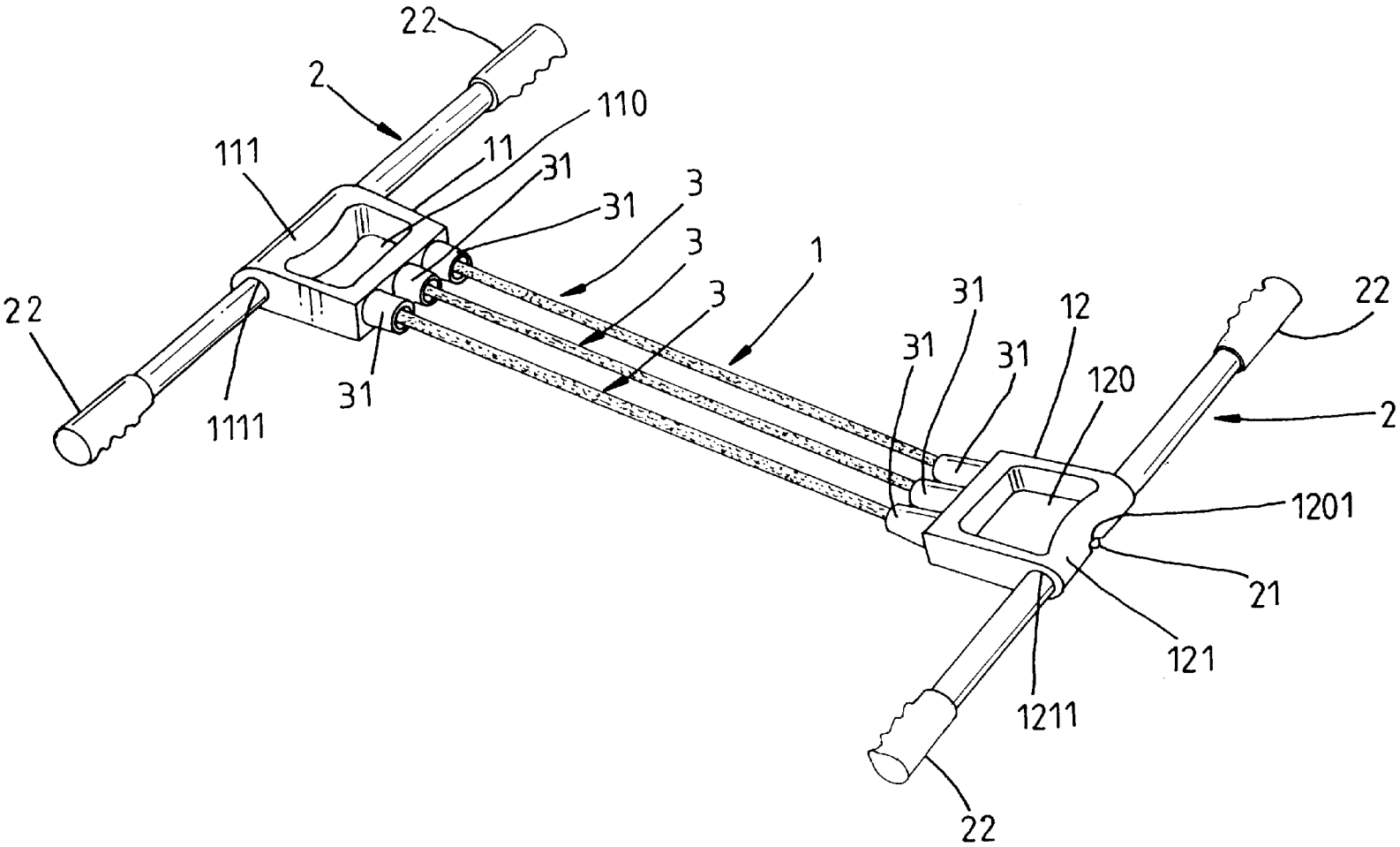
FIG. 25 is an elevational assembly view of the pulling exerciser of the fourth embodiment of the present invention.
Figure 26:
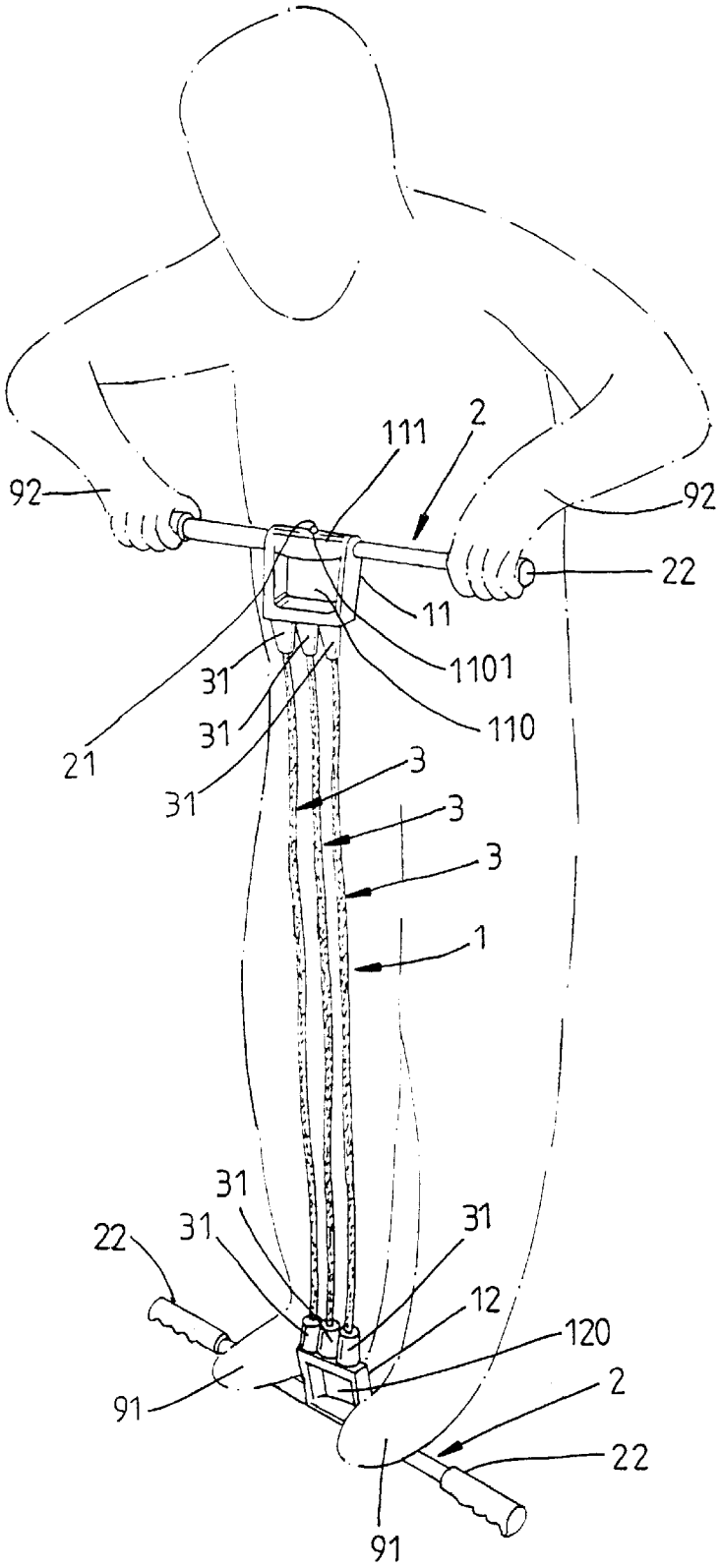
FIG. 26 shows an exercising example of the fourth embodiment of the present invention.
Figure 27:
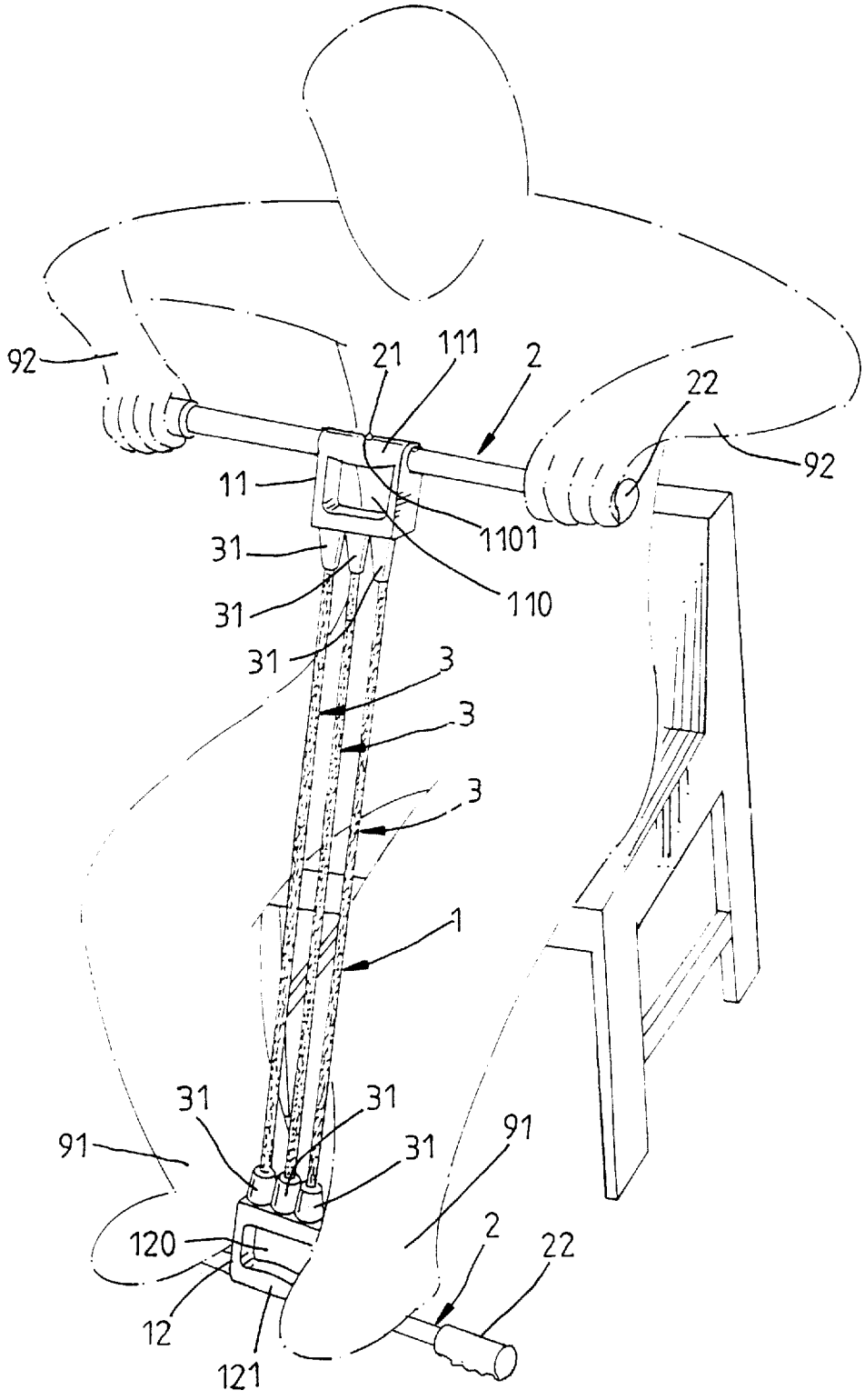
FIG. 27 shows another exercising example of the fourth embodiment of the present invention.

FIGS. 24 and 25 show a pulling exerciser constructed according to a fourth embodiment of the present invention. According to this embodiment, the pulling exerciser comprises a chest expander 1, and two transverse bars 2. The chest expander 1 is comprised of a first handle 11, a second handle 12, and three elastic cord members 3 detachably connected between the first handle 11 and the second handle 12. The structure of the handles 11 and 12 and the structure of the elastic cord members 3 are identical to the handles and elastic cord members of the aforesaid embodiments. The transverse bars 2 are respectively fastened to the axle holes 1111 and 1211 of the handles 11 and 12. FIGS. 26 and 27 show two different exercising examples of the fourth embodiment of the present invention.

Referring to FIGS. 24 and 26, the handgrip 111 or 121 of each handle 11 or 12 comprises a plurality of locating holes 1101 or 1201 respectively disposed on the inside in communication with the respective axle hole 1111 or 1211; each transverse bar 2 has at least one spring-supported locating pin 21 adapted to engage the locating holes 1101 or 1201 in the handgrip 111 or 112 of the corresponding handle 11 or 12.

As indicated above, the invention achieves the following advantages:

1. After the door panel 5 has been closed and the transverse bar 2 has been retained to the door panel 5 at the top or bottom side, the user can pull the second handles 12 with the hand or hands to exercise the muscles of the arm(s) when standing or sitting behind the door (see Figures from 7 through 18).
2. The pulling exerciser can be used with the connecting belt 81 and the gaiter 82 for exercising the muscles of the leg (see FIGS. 19 and 20).
3. The loops 41 and 42 can be made of fabric material and respectively fastened to the belt 4 by stitches to save the manufacturing cost of the pulling exerciser.
4. The transverse bar 2 can be a plain rod member for insertion through the loops 41 and 42 of the belt 4, so that the diameter of the transverse bar 2 can be minimized.
5. Because the elastic cord members 3 are fastened to the handles 11 and 12 by a screw joint, the connection between the elastic cord members 3 and the handles 11 and 12 is tight; further, the belt 4 is a high-strength fabric belt. which is durable in use.

6. Two transverse bars 2 can be used with the chest expander 1 for pulling exercises (see Figures from 24 through 27).

7. Because the elastic cord members 3 each have two swivel connectors 31 at two distal ends for selectively fastened to the screw rods 112 and 122 of the handles 11 and 12, the user can adjust the resisting force of the chest expander 1 to fit different exercising requirements.

A prototype of pulling exerciser has been constructed with the features of the annexed drawings. The pulling exerciser functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A pulling exerciser comprising:

a chest expander, said chest expander comprising a first handle, at least one second handle, at least one elastic cord member detachably connected between said first handle and said at least one second handle, said first handle and said at least one second handle each comprising a center opening, a handgrip disposed at one side of said center opening, said handgrip defining an axially extended axle hole, and a plurality of screw rods disposed at one side of said center opening opposite to the respective handgrip, said at least one elastic cord member each comprising two swivel cap nuts respectively disposed at two distal ends and adapted for threading onto one screw rod of said first handle and one screw rod of one of said at least one second handle;

at least one transverse bar fitting the axle hole of the handgrip of each of said first handle and said at least one second handle; and a coupling belt inserted through the center opening of said first handle and coupled to one of said at least one transverse bar, said coupling belt comprising a first loop and a second loop respectively disposed at two distal ends thereof and respectively coupled to one of said at least one transverse bar, a fixed tape of hook material and a fixed tape of loop material adapted to secure the two distal ends of said coupling belt together after insertion of said coupling belt through the center opening of said first handle.

2. The pulling exerciser of claim 1 further comprising a connecting belt fastened to said at least one second handle, and a gaiter coupled to said connecting belt and adapted to secure said connecting belt to the user's leg, said connecting belt comprising a fixed tape of hook material and a fixed tape of loop material adapted for fastening said connecting belt to said at least one second handle, a connecting ring, and a carbin hook coupled to said connecting ring, said carbin hook comprising an open ring, said open ring having two screw rods disposed at two distal ends thereof and aimed at each other and spaced from each other by a gap, and a screw nut threaded onto the screw rods of carbin hook and rotated forwards/backwards to close/open said gap, said gaiter comprising a fixed tape of hook material and a fixed tape of loop material adapted to secure said gaiter to the user's leg, and a connecting ring adapted for securing to said carbin hook.

3. A pulling exerciser comprising:

a chest expander, said chest expander comprising a first handle, a second handle, at least one elastic cord member detachably connected between said first handle and said second handle, said first handle and said second handle each comprising a center opening, a handgrip disposed at one side of said center opening, said handgrip defining an axially extended axle hole and at least one locating hole disposed on the inside in communication with said axially extended axle hole, and a plurality of screw rods disposed at one side of said center opening opposite to the respective handgrip, said at least one elastic cord member each comprising two swivel cap nuts respectively disposed at two distal ends and adapted for selectively threading onto the screw rods of said first handle and said second handle; and two transverse bars respectively fastened to the axle hole of each of said first handle and said second handle, said transverse bars each comprising at least one spring-supported locating pin adapted to engage the at least one locating hole in the handgrip of each of said first handle and said second handle.

* * * * *